US012092409B1

(12) United States Patent
McHann

(10) Patent No.: US 12,092,409 B1
(45) Date of Patent: Sep. 17, 2024

(54) TRIGGER MECHANISM FOR A RIFLE

(71) Applicant: Mountain Tactical Company, Bozeman, MT (US)

(72) Inventor: Jason McHann, Bozeman, MT (US)

( * ) Notice: Subject to any disclaimer, the term of this patent is extended or adjusted under 35 U.S.C. 154(b) by 0 days.

(21) Appl. No.: 18/225,147

(22) Filed: Jul. 23, 2023

(51) Int. Cl.
*F41A 17/32* (2006.01)
*F41A 19/10* (2006.01)

(52) U.S. Cl.
CPC ..... *F41A 17/32* (2013.01); *F41A 19/10* (2013.01)

(58) Field of Classification Search
CPC ..... F41A 17/32
See application file for complete search history.

(56) References Cited

U.S. PATENT DOCUMENTS 1,446,763 A * 2/1923 Nelson ..... F41A 17/32 42/70.01
2,514,981 A * 7/1950 Walker ..... F41A 17/32 42/70.01
2,869,269 A * 1/1959 Couture ..... F41A 17/32 42/70.01
3,024,559 A * 3/1962 Weatherby ..... F41A 19/15 42/70.06
4,054,003 A 10/1977 Wilson
4,391,058 A * 7/1983 Casull ..... F41A 19/30 42/69.02
4,471,551 A * 9/1984 Mattarelli ..... F41A 17/00 42/70.01
4,569,145 A * 2/1986 Ruger ..... F41A 17/32 42/16
4,651,455 A 3/1987 Geiser, Jr.
4,730,406 A * 3/1988 Forbes ..... F41A 17/32 42/70.01
4,870,770 A * 10/1989 Forbes ..... F41A 17/32 42/70.01
5,551,180 A * 9/1996 Findlay ..... F41A 17/32 42/70.01

(Continued)

FOREIGN PATENT DOCUMENTS

DE 1034513 B 7/1958
GB 191105130 A 12/1911
NO 124706 B * 5/1972

OTHER PUBLICATIONS

Winchester Model 70 Bolt Actin Rifle Owners Manual; Source: https://www.winchesterguns.com/content/dam/winchester-repeating-arms/support/owners-manuals/2021/20-WRA-338 Model%.

(Continued)

*Primary Examiner* — Gabriel J. Klein
(74) *Attorney, Agent, or Firm* — Antoinette M. Tease

(57) ABSTRACT

A trigger mechanism for a rifle having a trigger housing, a trigger, a cocking piece, a bolt lock, a pivotable safety key, a pivotable sear, a sear engagement, and a ball détente spring. The sear engagement is fixedly attached to the upper part of the trigger. The safety key has a bolt lock guide that is configured to move the bolt lock among three different positions, each of which corresponds to a position of the ball détente spring on the inside of the safety key. When the bolt lock is in the first position, neither the bolt nor the trigger can move. When the bolt lock is in the second position, the bolt is free to rotate, but the trigger cannot move. When the bolt lock is in the third position, the bolt is free to move, and the trigger can also move.

9 Claims, 23 Drawing Sheets

(56) References Cited

U.S. PATENT DOCUMENTS

| | | | | | |
|---|---|---|---|---|---|
| 5,615,507 | A * | 4/1997 | French | F41A 17/56 | 42/69.02 |
| 5,752,338 | A * | 5/1998 | Lameiras Guede | F41A 17/46 | 42/70.06 |
| 5,784,818 | A * | 7/1998 | Otteson | F41A 17/56 | 42/70.04 |
| 6,018,900 | A * | 2/2000 | Guede | F41A 17/32 | 42/70.06 |
| 6,073,380 | A * | 6/2000 | Hauser | F41A 19/16 | 42/70.08 |
| 6,886,285 | B1 * | 5/2005 | Sirkis | F41A 17/32 | 42/70.08 |
| 6,957,508 | B2 * | 10/2005 | Sato | F41A 17/32 | 42/14 |
| 8,132,349 | B1 * | 3/2012 | Huber | F41A 19/12 | 42/69.01 |
| 8,677,665 | B1 * | 3/2014 | Huber | F41A 19/42 | 42/69.01 |
| 9,255,750 | B1 | 2/2016 | Huber | | |
| 11,293,715 | B1 | 4/2022 | Newsome et al. | | |
| 2011/0030261 | A1 | 2/2011 | Karagias | | |

OTHER PUBLICATIONS

Kimber Bolt Action Rifle Manual. Source: https://www.kimberamerica.com/pub/media/custom_fields/102bba9500070d4394028037d212107e/KimberRifleManual_APR16_LR.pdf Publication Date: Apr. 1, 2016.

The Different Types of Firearm Safeties; Source: https://www.nrawomen.com/content/the-different-types-of-firearm-safeties/ Publication Date: Mar. 31, 2022.

* cited by examiner

TRIGGER MECHANISM FOR A RIFLE

BACKGROUND OF THE INVENTION

1. Field of the Invention

The present invention relates generally to the field of firearms, and more particularly, to a trigger mechanism for a rifle.

2. Description of the Related Art

Certain rifles utilize a trigger safety system that requires a shooter to place the firearm in an unsafe position in order to remove a loaded cartridge from the firearm's chamber. The purpose of a firearm safety is to prevent the firearm from potentially igniting a cartridge as a result of mechanical failure or accidental discharge by the shooter, creating a potentially fatal occurrence.

Some rifles use a bolt lock that prevents the firearm's bolt from opening while the safety is in the "safe" position. If there is a loaded cartridge in the chamber of the firearm, the shooter must move the safety to the "fire" position to open the bolt and remove the loaded cartridge. If, during this process, the shooter bumps the trigger, or there is a mechanical failure in the firearm, the cartridge can ignite, sending a projectile at deadly velocities toward an unintended target.

The present invention is a trigger system with a safety mechanism that allows the bolt lock to continue to function when the safety lever is in the primary "safe" position and provides a secondary "safe" position that unlocks the bolt lock while maintaining a mechanical interference designed to prevent the firing pin from moving forward and igniting a loaded cartridge in the chamber. By allowing the rifle to remain in a safe condition while a cartridge is unloaded from the rifle's chamber, the potentially deadly condition of the rifle is avoided.

Aside from the present invention, the only current solutions for this problem involve eliminating the bolt stop from the trigger mechanism altogether. These solutions, however, suffer from several disadvantages. For example, the rifle bolt may come open during use, a cartridge may randomly fall out of the rifle, or debris may be introduced into the chamber. Each of these occurrences may have catastrophic consequences. By retaining the bolt stop feature of the trigger mechanism, the present invention enhances safety for the firearm operator, as well as other people and objects within the firing range of the firearm. The inventions discussed below present three-position trigger mechanisms, but none of these inventions is structurally similar to the present invention.

U.S. Pat. No. 4,730,406 (Forbes et al., 1988) and U.S. Pat. No. 4,870,770 (Forbes et al., 1989) describe a bolt release trigger safety mechanism for firearms that incorporates a three-position, or three-stage, safety mechanism for firearms that allows release of a locked breech bolt mechanism while the safety lever is in the "safe" position (with the trigger and/or the sear mechanism locked). The invention is configured so that the operator is prohibited from inadvertently moving the safety lever to a "fire" position while depressing the safety lever. The invention is comprised of a safety lever that is moveably mounted onto a trigger housing, a safety arm that is engaged and moveable with the safety lever, and a bolt arm lock that is engaged and moveable with the safety lever. In a first position, the safety lever causes the bolt arm lock to engage the bolt, thereby preventing it from being rotated, while the safety arm engages with the sear to prevent the firing pin from sliding. In a second position, the safety lever releases the bolt arm lock from the bolt, thereby permitting the bolt to be operated or removed, while the fire pin is still prevented from sliding forward. In a third position, the safety lever causes the bolt arm lock to disengage the bolt, thereby allowing the bolt to rotate, while the safety arm disengages the sear and allows the firing pin to slide forward.

U.S. Pat. No. 6,073,380 (Hauser et al., 2000) provides a three-position safety with trigger- and bolt-engaging positions for a firearm. The safety lever has a release position, a first locking position, and a second locking position. The bolt is able to move in the release position and in the first locking position but not in the second locking position. The trigger is prevented from moving in the first and second locking positions but allowed in the release position. The invention includes a leaf spring, which prevents movement of the trigger when the leaf spring is in a blocking position, and which allows motion of the trigger when the leaf spring is in an unblocking position. The safety lever cooperates with the movable portion of the leaf spring so that when the safety lever is placed into the first or second locking positions, the movable portion of the leaf spring is placed into a blocking position.

U.S. Pat. No. 6,886,285 (Sirkis et al., 2005) discloses a three-position safety for a bolt-action rifle that includes a rotatable lever that moves from a first position in which the bolt and firing pin are both unlocked, to a second position in the which the bolt is unlocked and the firing pin is locked, to a third position in which the bolt and firing pin are both locked. A detent member has a detect surface that mates with detent apertures on the end of the bolt. When the safety lever is in the first or second position, there is a gap between the shaft of the plunger and the detent member, and this gap allows for rotational movement of the bolt relative to the cocking piece housing. When the lever is in the third position, the shaft of the plunger contacts the detect member to prevent rotational movement of the bolt.

U.S. Pat. No. 6,957,508 (Sato, 2005) involves a safety mechanism for a bolt-action firearm with first, second and third positioning holes in the safety lever. When a tapered outer end part of the safety lock (or trigger blocking member) is engaged with the first positioning hole, the upper arm of the trigger is blocked by the safety lock, and the bolt is also locked. When the safety lever is in a safety position, the bolt is free to move, but the trigger is prevented from moving by the trigger blocking part of the safety lock. When the safety control member is in the third position, the trigger blocking part of the trigger blocking member is retracted from the moving path of the upper arm of the trigger, thereby permitting the trigger to move.

U.S. Patent Application Pub. No. 20110030261 (Karagias) relates to a firearm with a small trigger pull force, a small trigger pull distance, and a large sear engagement. In one embodiment, the safety is a three-position safety mechanism that is actuated by the thumb of the shooter's hand using the safety grip while in the shooting position. A safety detent ball may be spring-loaded by a safety detent spring and configured to engage detents machined into the receiver to provide tactile feedback to the shooter. A safety hook is configured to engage with a sear catch safety pin, and a sear roller pin clearance cut is configured so that the sear roller pin can drop into the sear roller pin clearance cut. With the safety in a first position, the shooter can discharge the firearm and also manipulate the bolt assembly to load or unload the firearm. With the safety in a second position, the trigger assembly is prevented from moving, but the bolt assembly can still rotate. With the safety in a third position, the sear assembly, trigger assembly, and bolt assembly are all prevented from moving.

BRIEF SUMMARY OF THE INVENTION

The present invention is a trigger mechanism for a rifle comprising: a trigger housing; a trigger; a cocking piece; a bolt lock; a safety key that is configured to pivot relative to the trigger housing; wherein the safety key comprises a bolt lock guide; wherein the bolt lock guide is configured to fit within a recess in the bolt lock; wherein the bolt lock guide is configured to move among a first position, a second position, and a third position as the safety key is rotated; and wherein when the bolt lock guide is in the first position, the bolt is prevented from rotating, and when the bolt lock guide is in the second position or the third position, the bolt is free to rotate; a sear that is pivotally connected to the trigger housing at a sear pivot point; wherein the sear is configured to pivot between a first position and a second position; and wherein when the sear is in the first position, the sear is configured to prevent the cocking piece from moving forward, and when the sear is in the second position, the cocking piece is able to move forward; a sear engagement that is fixedly attached to an upper part of the trigger and configured to rock forward when a bottom part of the trigger is pulled by a user; wherein when the bolt lock guide is in the first position or the second position, a rear end of the bolt lock guide abuts up against a front face of the sear engagement, thereby preventing the sear engagement from rocking forward; and wherein when the bolt lock guide in in the third position, the sear engagement is free to rock forward; and a ball détente spring; wherein the ball détente spring is configured to move among a first position, a second position, and a third position on an inside surface of the safety key.

In a preferred embodiment, the safety key is fixedly connected to a safety lever; wherein the safety lever with a bottom end is fixedly connected to a safety knob; and wherein the bottom end of the safety lever is connected to the safety key at a safety key pivot point. The invention further comprises a trigger spring plunger that is configured to maintain the trigger in an upright position when the trigger spring plunger is uncompressed. The invention further comprises a sear spring that is configured to maintain the sear in the first position when the sear spring is uncompressed.

In a preferred embodiment, the invention further comprises a sear stop that is attached to the trigger housing and configured to prevent the sear from over-rotating. Preferably, the cocking piece comprises an annular collar and a base; wherein the cocking piece further comprises an arcuate extension that is configured to fit within a concave recess at a rear end of the bolt; and wherein the annular collar is configured to receive a proximal end of a firing pin. A sear spring is preferably situated within a compartment inside of the trigger housing; wherein a bottom end of the sear spring is in contact with a bottom of the compartment; and wherein a top end of the sear spring is in contact with a lower surface of the sear forward of the sear pivot point.

In a preferred embodiment, the sear comprises a top part, a nose, and a lower claw; and when the sear is in the first position, a bottom part of the lower claw is in contact with a curved rear face of the sear engagement, and a top edge of the lower claw is situated on top of a flat top surface of the sear engagement. When the sear is in the second position, the lower claw is disengaged from the sear, the nose moves downward along a curved rear face of the sear, and the top part of the sear rotates downward, thereby disengaging the sear from the cocking piece.

REFERENCE NUMBERS

Figure 1:
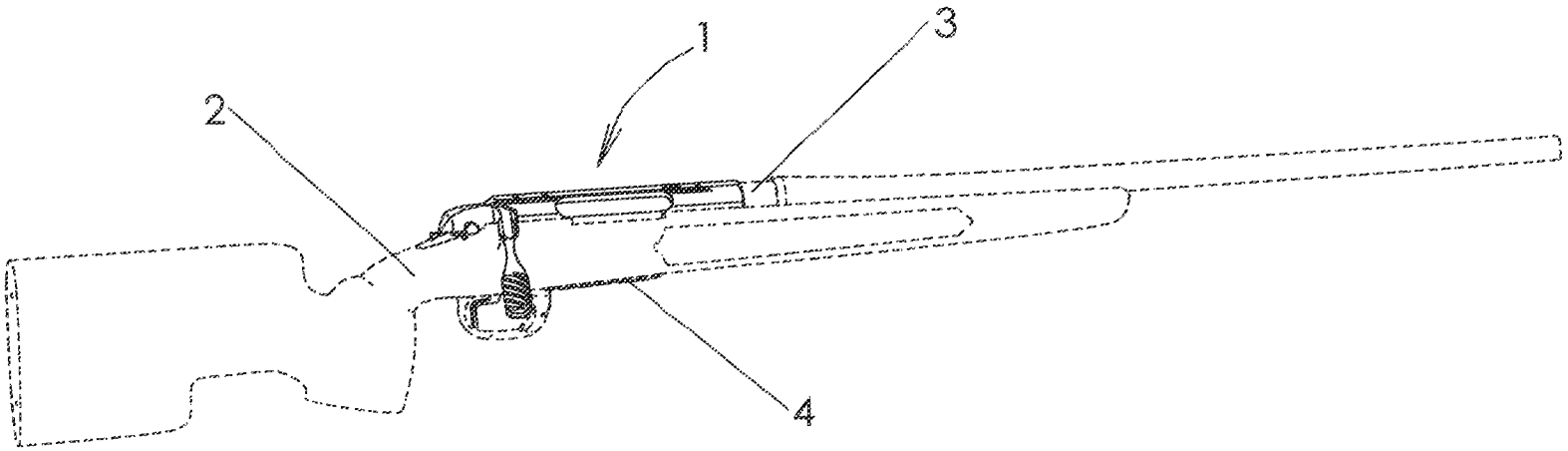
FIG. 1 is a perspective view of the present invention installed on a rifle.

1 Action (of a rifle)
2 Stock
3 Barrel

4 Magazine
5 Bolt lever
6 Action housing
7 Trigger
7*a* Upper arm (of trigger)
8 Trigger housing
8*a* Compartment (in trigger housing)
9 Safety knob
9*a* Safety lever
10 Safety key
11 Bolt shroud
12 Cocking piece
12*a* Annual collar (of cocking piece)
12*b* Base (of cocking piece)
12*c* Arcuate extension (of cocking piece)
13 Shoulder screw
14 Slot (in safety key)
15 Set screw
16 Bolt
16*a* Concave recess (on rear end of bolt)
16*b* Recess (for receiving bolt lock)
17 Bolt lock
17*a* Recess (in bolt lock)
18 Sear
18*a* Window (in sear)
18*b* Lower claw (of sear)
18*c* Nose (of sear)
18*d* Top part (of sear)
19 Ball détente spring
19*a* Ball (in ball détente spring)
20 Trigger spring plunger
21 Sear spring
22 Sear engagement
22*a* Lower leg (of sear engagement)
22*b* Curved rear face (of sear engagement)
22*c* Flat top surface (of sear engagement)
23 Receptacle (on safety key)
23*a* Channel
24 Sear stop
25 Bolt lock guide (on safety key)
26 [Intentionally omitted]
27 Compression spring (inside of bolt)
28 Collar
29 Bolt seat
30 Firing pin

DETAILED DESCRIPTION OF INVENTION

FIG. 1 is a perspective view of the present invention installed on a rifle. The purpose of this figure is simply to illustrate the environment of the present invention, which is designed to work with a TIKKA™ bolt action rifle. The present invention may be used with other types of rifles as well.

Figure 2:
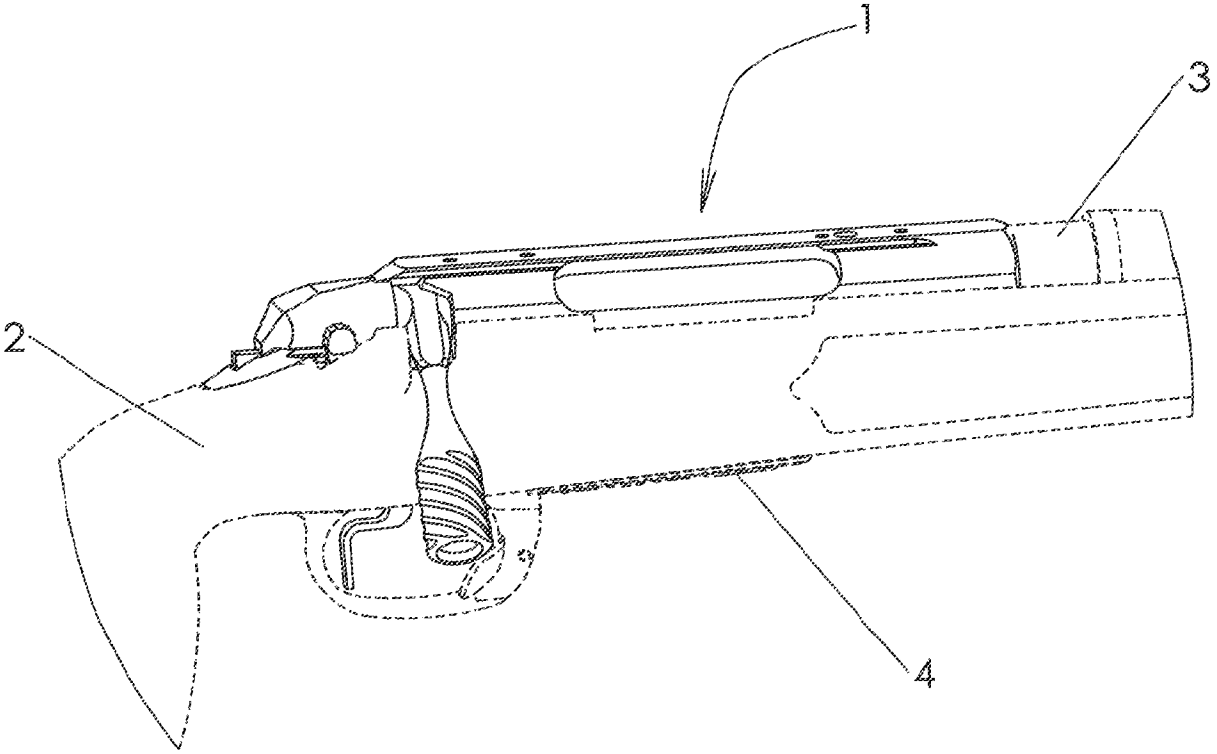
FIG. 2 is a detail perspective view of the present invention installed on a rifle.

FIG. 2 is a detail perspective view of the present invention installed on a rifle. This figure shows what is referred to as the "action" part of the rifle. The three main parts of a rifle are the stock, the barrel, and the action. The stock supports and action and, in some cases, the barrel. The barrel is a metal tube through which the projectile passes. The action 1 is that part of the rifle that loads, fires and ejects ammunition. The action 1 includes the trigger mechanism, which is the subject of the present invention. This figure also shows the stock 2, the barrel 3, and the magazine 4. The magazine 4 is that part of a firearm that stores and feeds ammunition into the action 1.

Figure 3:
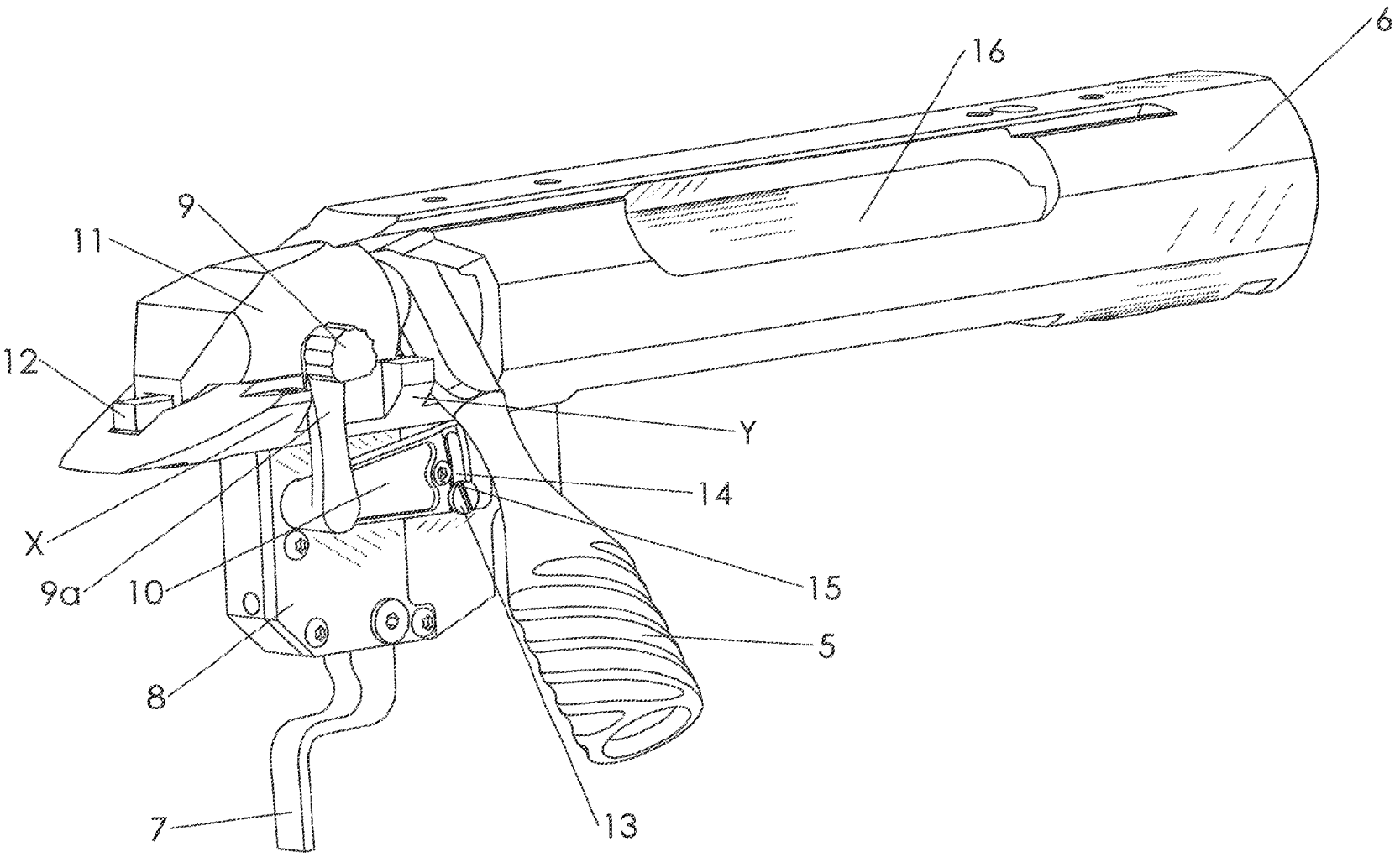
FIG. 3 is a perspective view of the present invention shown without the stock, barrel and magazine of the rifle.

FIG. 3 is a perspective view of the present invention shown without the stock, barrel and magazine of the rifle. This figure shows the bolt lever 5, the action housing 6, the trigger 7, and the trigger housing 8. It also shows the safety knob 9 and the safety key 10, which are configured to place the trigger mechanism in a first, second or third position, as discussed more fully below. In addition, this figure shows the bolt shroud 11 and the cocking piece 12. Note that the action housing 6 is configured to prevent the safety knob 9 from moving too far to the left or right, as indicated by "X" and "Y" on FIG. 3. In other words, the action housing 6 acts as a stop in relation to the safety knob 9. In FIG. 3, the safety knob 9 is in a first position, with the knob fully rotated toward the stock. With the safety knob 9 in this position, the shoulder screw 13 that extends through a slot 14 on the distal end of the safety key 10 is positioned at the bottom end of the slot 14. As the safety knob 9 is rotated forward (toward the distal end of the barrel and away from the user), the safety key 10 rotates downward, and the position of the shoulder screw 13 within the slot 14 moves upward. A set screw 15 situated on the distal end of the safety key 10 is configured to apply adjustable pressure against the trigger housing 8. Note that the safety knob 9 is attached to a safety lever 9*a*, the bottom of which is connected to the safety key 10 at the safety key pivot point (marked as dotted line "C" in FIG. 11).

Figure 4:
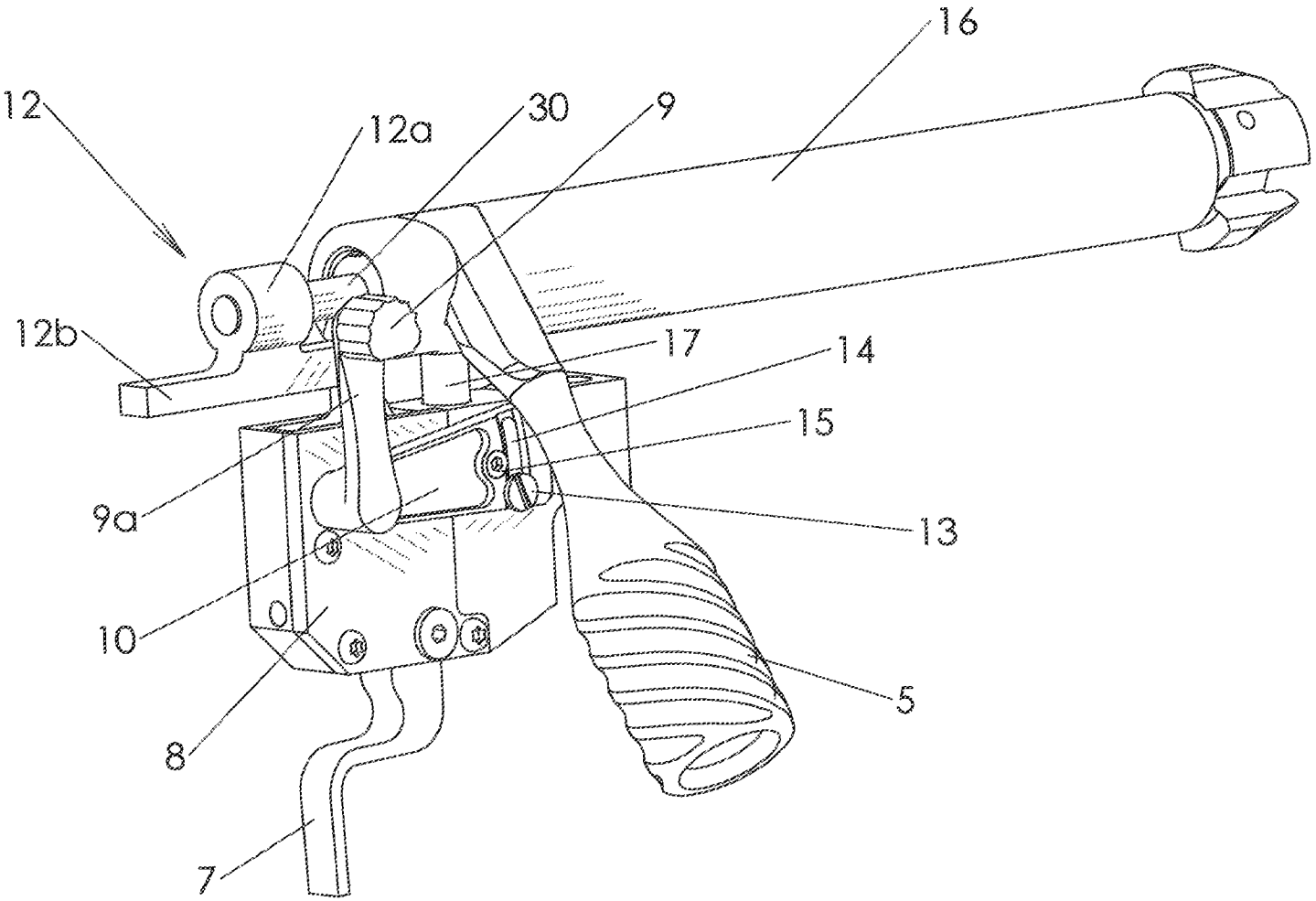
FIG. 4 is a first perspective view of the present invention shown with the action housing and bolt shroud removed and the safety key in a first position.

FIG. 4 is a perspective view of the present invention shown with the action housing and bolt shroud removed and the safety key in a first position. This figure shows the cocking piece 12 more clearly. The cocking piece 12 is comprised of an annular collar 12*a* and a base 12*b*. The proximal end of the firing pin 30 is inserted through the center of and secured to the annular collar 12*a* via a press fit, as shown. This figure also shows the bolt 16 and bolt lock 17. When the bolt lock 17 is in an "up" (or engaged) position, the bolt 16 is locked and cannot rotate. The bolt lever 5 is configured to rotate the bolt 16 circumferentially when the bolt lock 17 is in a "down" (or released) position. In this figure, the bolt lock 17 is in an "up" position, which means that the bolt 16 cannot rotate. As explained more fully below, with the safety key 10 in the position shown in this figure, the firing pin 30 is in a "safe" mode and cannot move forward. Thus, when the safety key 10 is in the first position, the bolt 16 is locked, and the firing pin cannot move forward.

Figure 5:
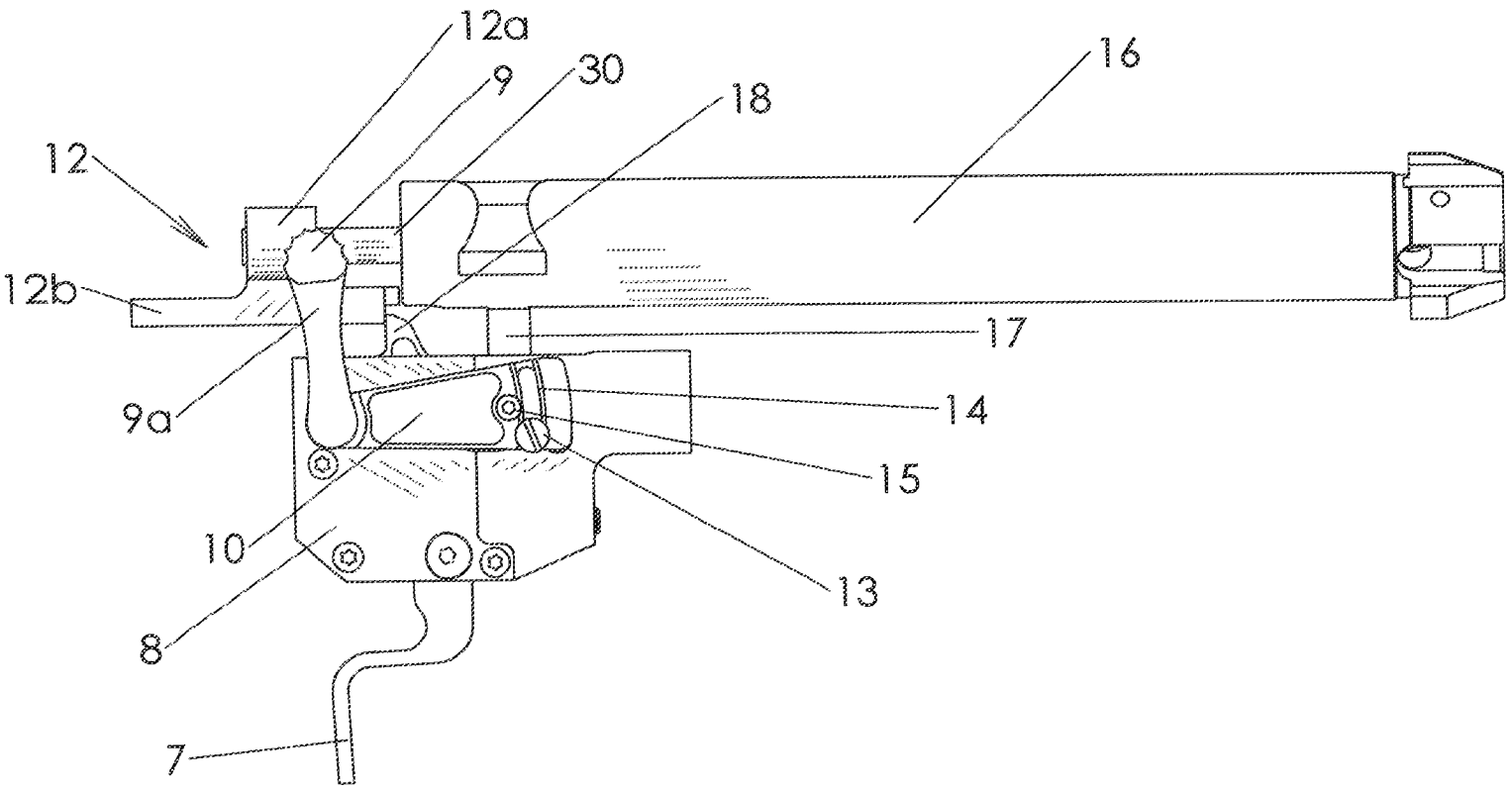
FIG. 5 is a first side view of the present invention as shown in FIG. 4.

FIG. 5 is a first side view of the present invention as shown in FIG. 4. This figure shows the sear 18, which prevents the cocking piece 12 from moving forward (to the right in this figure) when the sear 18 is in the position shown in FIG. 4. The sear 18 is that part of the trigger mechanism that holds the firing pin back until the correct amount of pressure has been applied to the trigger 7.

Figure 6:
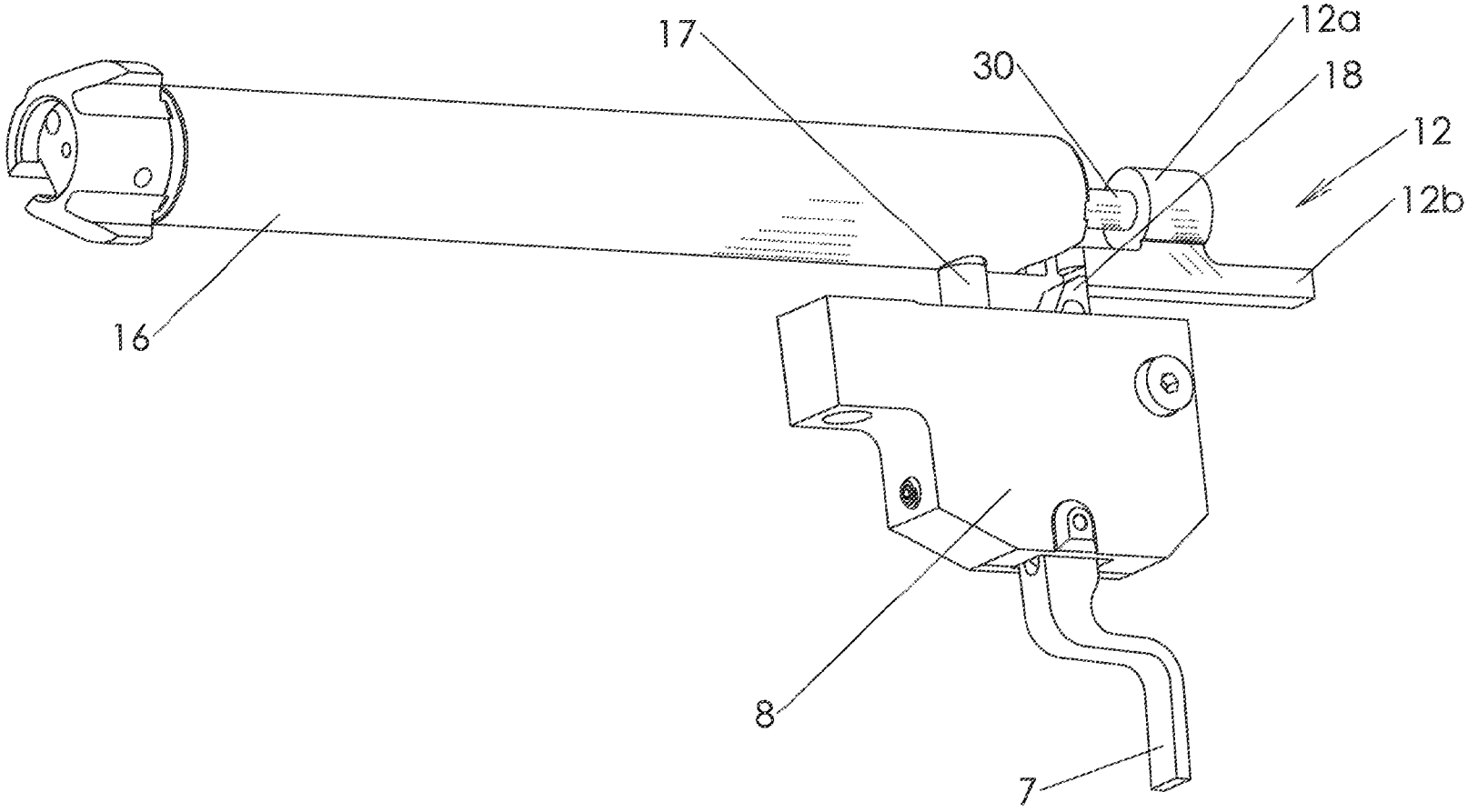
FIG. 6 is a second perspective view of the present invention as shown in FIG. 4.

FIG. 6 is a second perspective view of the present invention as shown in FIG. 4. As shown in this figure, the bolt lock 17 is in an "up" or engaged position (with the bolt lock inserted into the bolt itself), thereby preventing the bolt 16 from rotating, and the top part of the sear 18 is in contact with the front end of the cocking piece 12, preventing it from moving forward.

Figure 7:
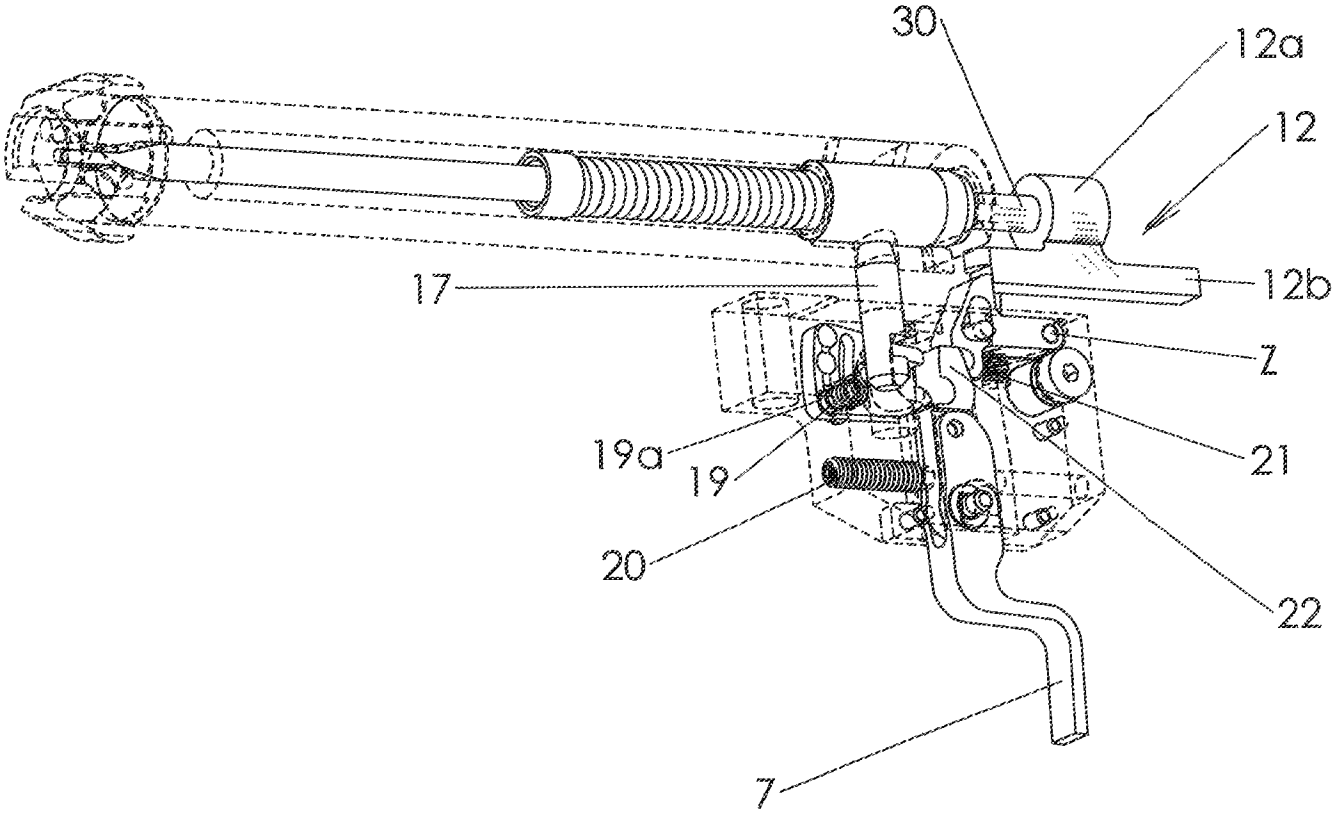
FIG. 7 is a perspective view of the present invention as shown in FIG. 6 but with the bolt and trigger housing shown in dotted lines for transparency.

FIG. 7 is a perspective view of the present invention as shown in FIG. 6 but with the bolt and trigger housing shown in dotted lines for transparency. This figure shows the ball détente spring 19, which will be discussed more fully in connection with FIG. 8. It also shows the trigger spring plunger 20 and the sear spring 21, both of which are discussed below. In addition, this figure shows more clearly the sear 18, which is pivotally connected to the trigger housing 8 at the pivot point marked as "Z" in FIG. 7. FIG.

7 also shows the sear engagement 22, which is situated between a bottom surface of the sear 18 and a top surface of the trigger 7.

Figure 8:
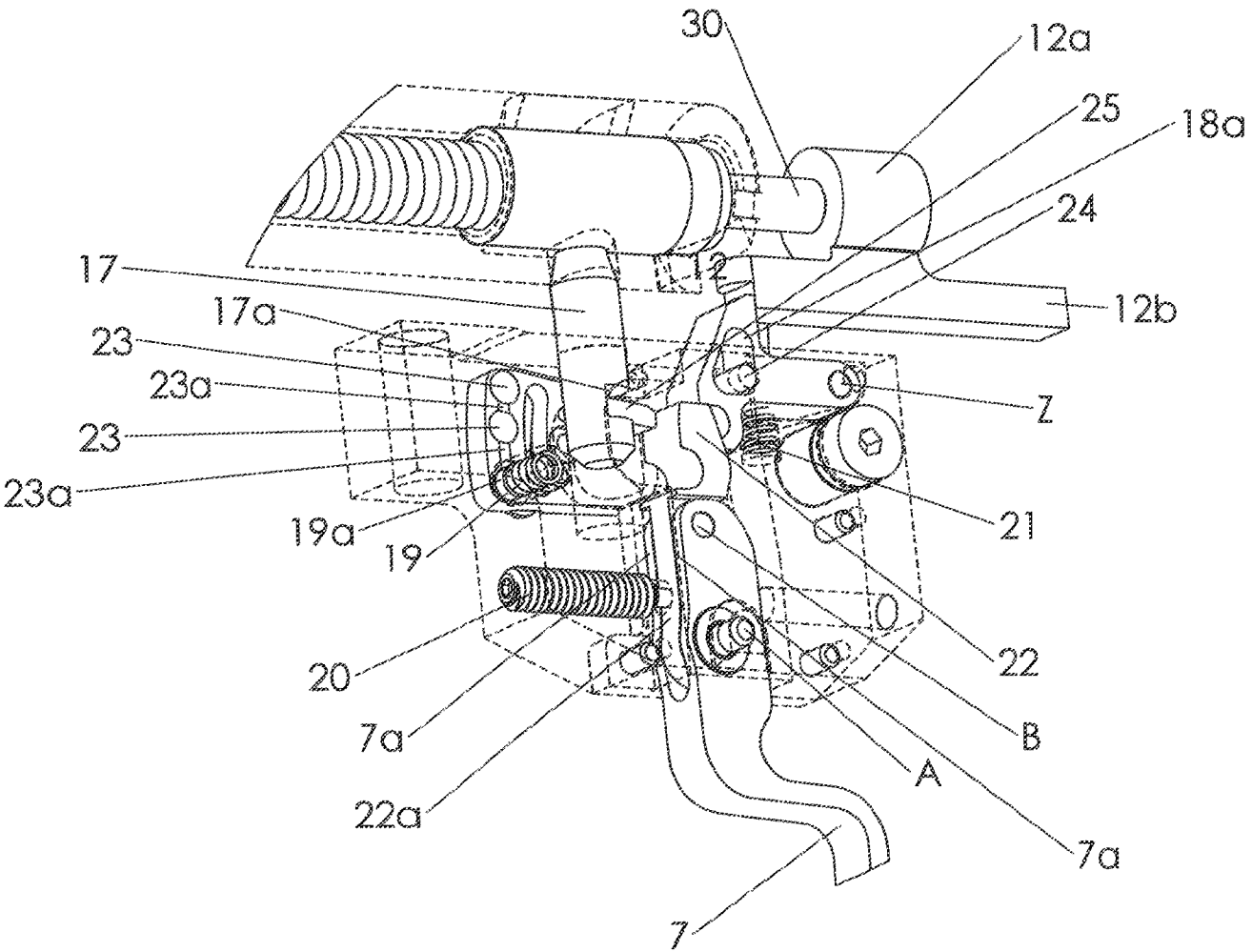
FIG. 8 is a detail perspective view of the trigger mechanism of the present invention.

FIG. 8 is a detail perspective view of the trigger mechanism of the present invention. The ball détente spring 19 is comprised of a steel alloy ball 19*a* that is situated on one end of the spring and configured to sit within one of three concave receptacles 23 on the interior of the safety key 10. When the safety knob 9 is pushed forward (at the same time, the manual force applied by the user overcomes the force of the ball détente spring 19), the safety key 10 rotates downward, and the ball 19*a* moves through a channel 23*a* between adjacent receptacles until the ball 19*a* is situated within the next-highest receptacle (see FIG. 14). The purpose of the ball détente spring 19 is to keep the ball 19*a* situated within one of the three receptacles 23*a* on the safety key 10 until and unless the user applies force to the safety knob 9.

Note that the sear engagement 22 comprises a lower leg 22*a*, which is situated between and secured to two upper arms 7*a* on the trigger 7. One end of the trigger spring plunger 20 is in contact with the lower leg 22*a* of the sear engagement 22, and the other end abuts up against the trigger housing 8. In this manner, when the trigger 7 is rotated by the user (by pulling the lower end of the trigger toward the rear or stock end of the firearm), the trigger spring plunger 20 is compressed, the sear engagement 22 moves forward, and the sear 18 moves relative to the sear engagement 22 (as is discussed more fully below). The purpose of the trigger spring plunger 20 is to bias the sear engagement 22 in a rearward position, as shown in FIG. 8. When the trigger spring plunger 20 is in this position, the sear 18 prevents the cocking piece 12 from moving forward, which in turn prevents the firing pin from moving forward.

The sear spring 21 is configured to bias the sear 18 into the position shown in FIG. 8, in which the sear 18 abuts up against the cocking piece 12. This particular spring is discussed more particularly below in connection with FIG. 10. A sear stop 24, which is in the form of a dowel pin and which is attached on both ends to the trigger housing 8, prevents the sear 22 form over-rotating. The sear stop 24 extends through a central aperture or window 18*a* in the sear 22, as shown; this window is sized and configured to provide the desired degree of rotation of the sear.

Figure 23:
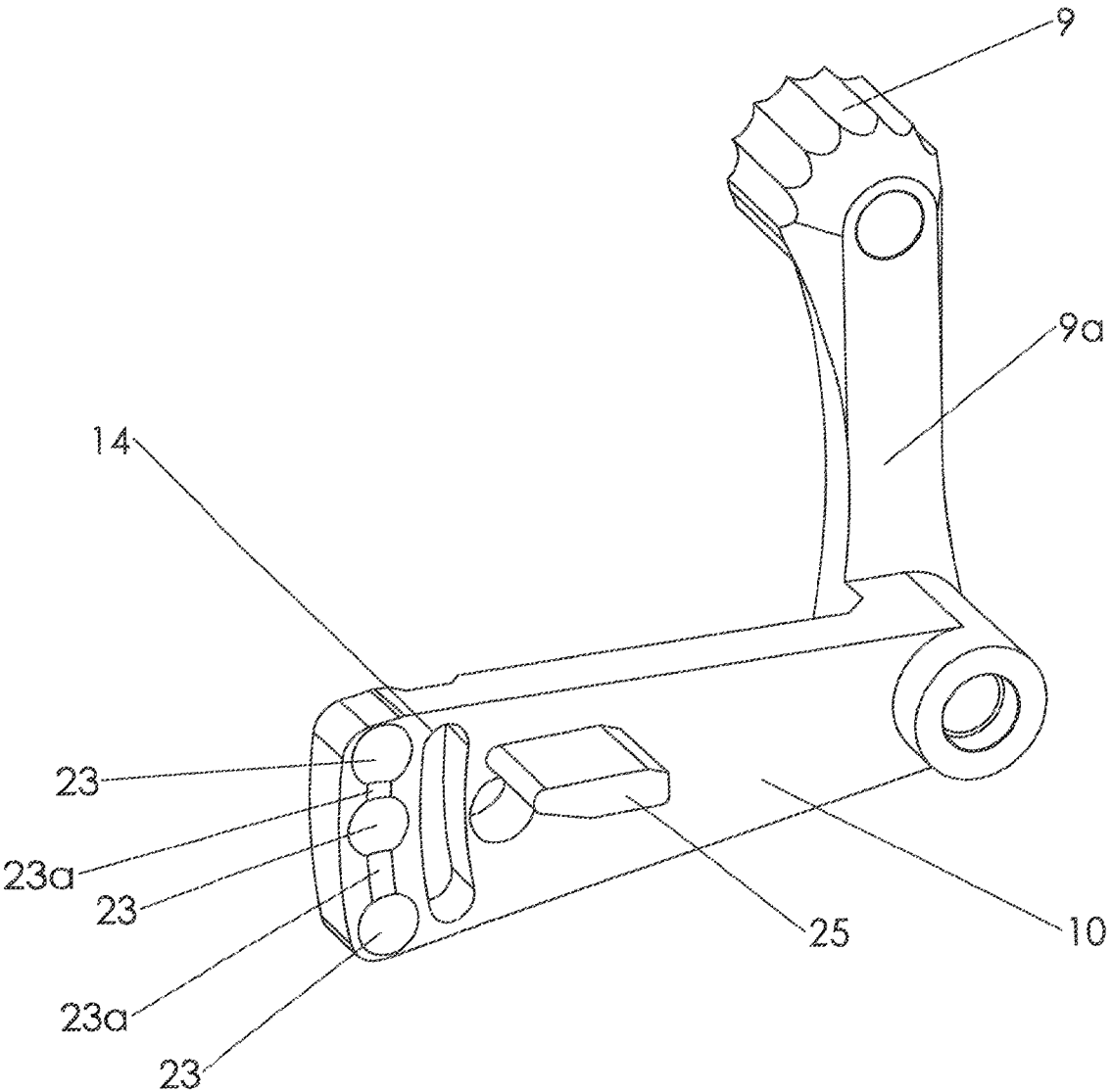
FIG. 23 is a perspective view of the safety key of the present invention.

Note that the safety key 10 comprises a bolt lock guide 25, which is positioned on the inside of the safety key 10 and configured to fit into a recess 17*a* in the bolt lock 17 (see also FIG. 23). When the safety key 10 is in the position shown in FIG. 8, the bolt lock 17 is inserted into the bolt 16 itself, thereby preventing the bolt 16 from rotating. When the safety key 10 is rotated downward, the bolt lock guide 25 pushes the bolt lock 17 downward as well (see FIGS. 14 and 19).

Figure 9:
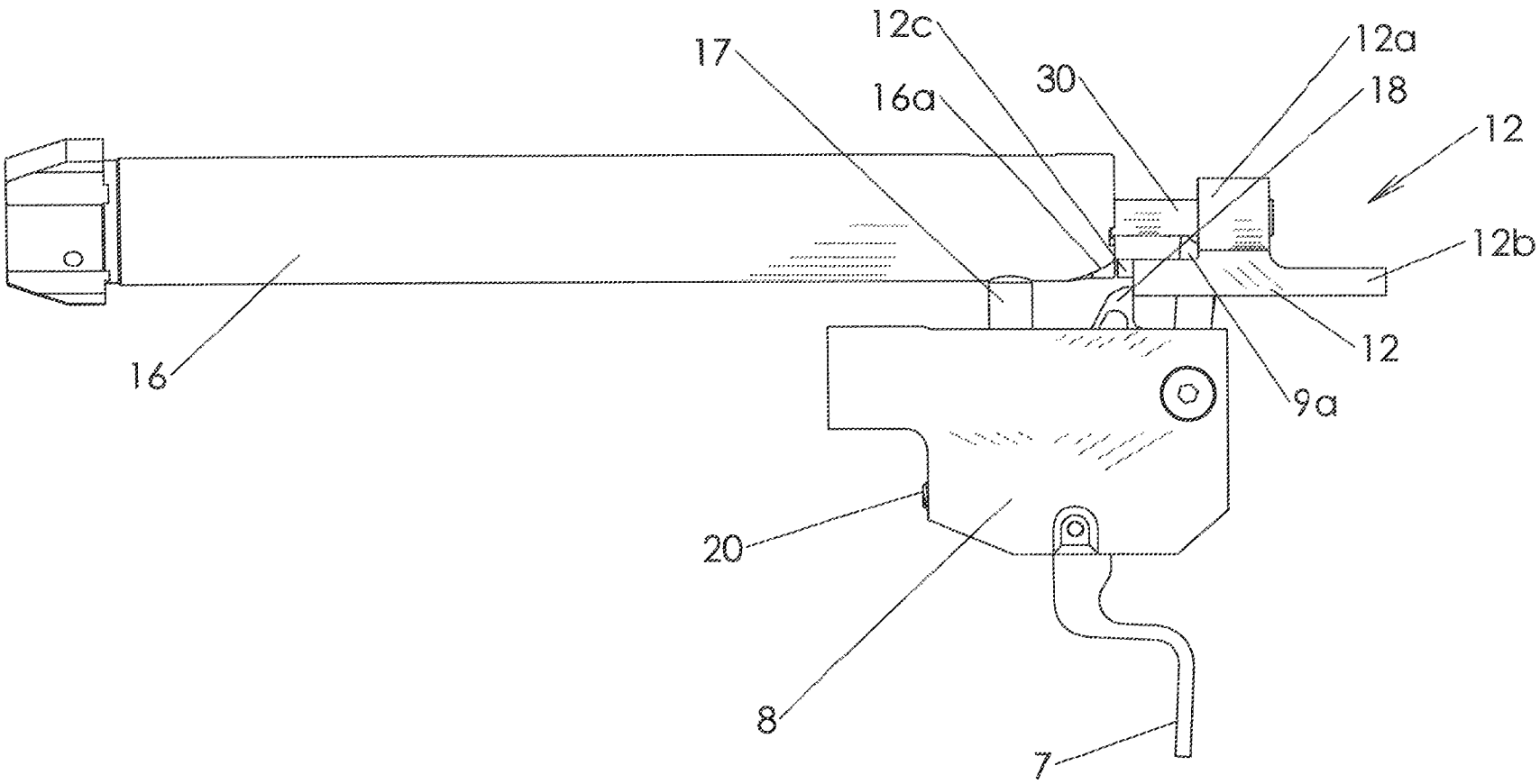
FIG. 9 is a second side view of the present invention as shown in FIG. 4.

FIG. 9 is a second side view of the present invention as shown in FIG. 4. As shown in this figure, the front end of the cocking piece 12 comprises an arcuate extension 12*a*, which is configured to fit within a concave recess 16*a* at the rear end of the bolt 16.

Figure 10:
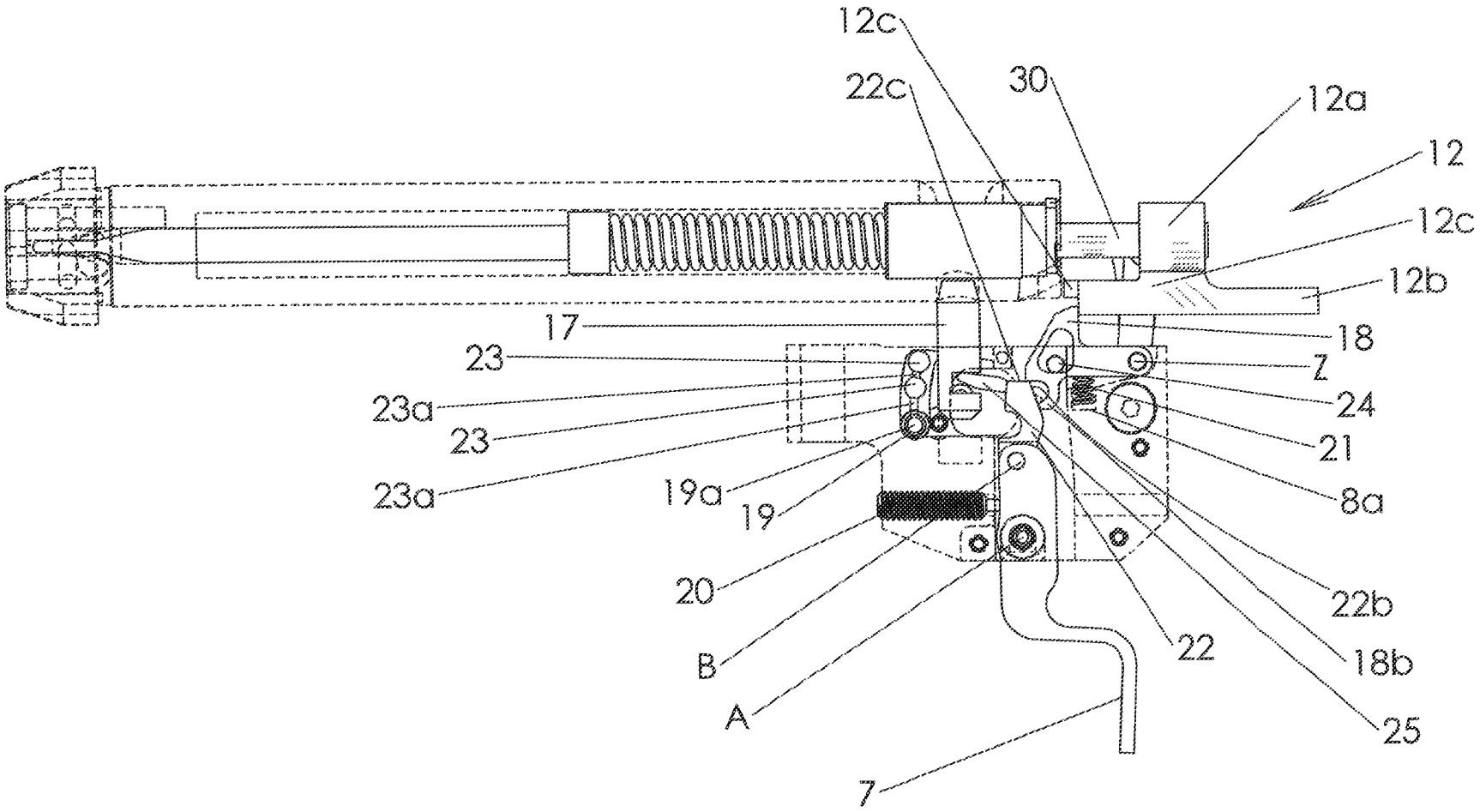
FIG. 10 is a side view of the present invention as shown in FIG. 7.

FIG. 10 is a side view of the present invention as shown in FIG. 7. As shown in this figure, the sear spring 21 is situated within a compartment 8*a* inside of the trigger housing 8. The bottom end of the sear spring 21 is in contact with the bottom of this compartment 8*a*, and the top end of this spring is in contact with a lower surface of the sear 18 forward of the sear pivot point "Z" (see also FIG. 7), In this manner, the sear spring 12 is configured to bias the sear 18 upward so that it is in the position shown in FIG. 10 (preventing the cocking piece from moving forward). When the bottom part of the trigger 7 is pulled backward, the top part of the trigger 7 rocks (or rotates) forward on pivot point "A" (see FIG. 14), carrying the sear engagement 22 with it. Note that the sear engagement 22 is secured to the trigger arms 7*a* at point "B" (see also FIG. 8). The sear 18 comprises a lower claw 18*b*, which is situated beneath the aperture 18*a* and forms the bottom part of the sear. In the position shown in FIG. 10 (which is still the first position or "safe" mode), the bottom part of the claw 18*b* is in contact with the curved rear face 22*b* of the sear engagement 22, and the top edge of the claw 18*b* is resting on top of the flat top surface of the sear engagement 22.

Figure 11:
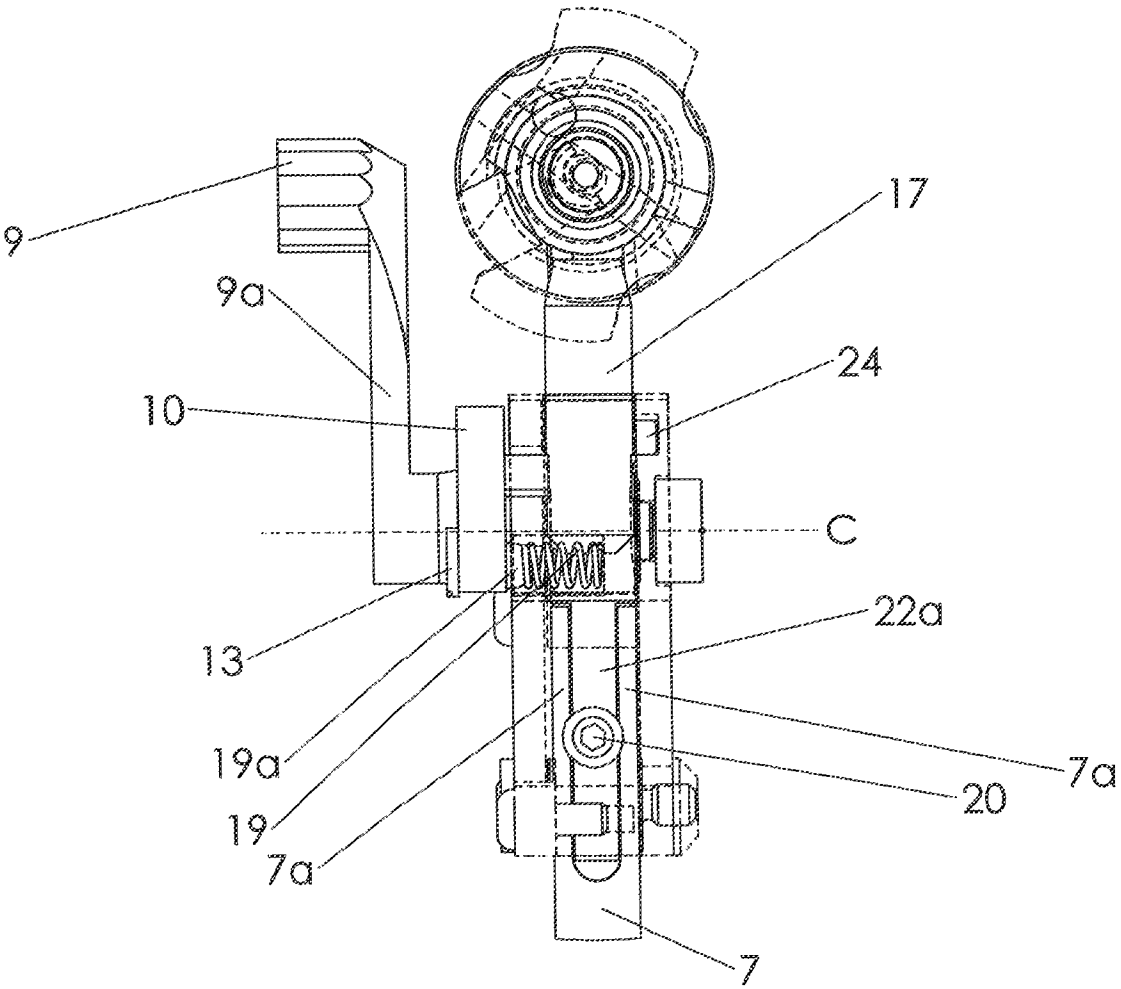
FIG. 11 is a front view of the present invention as shown in FIG. 10.

FIG. 11 is a front view of the present invention as shown in FIG. 10. The purpose of this figure is to illustrate the positioning of the ball détente spring 19 in relation to the safety key 10. As shown here, one end of the ball détente spring 19 is anchored to the trigger housing 8, and the other end is attached to the ball 19*a*.

Figure 12:
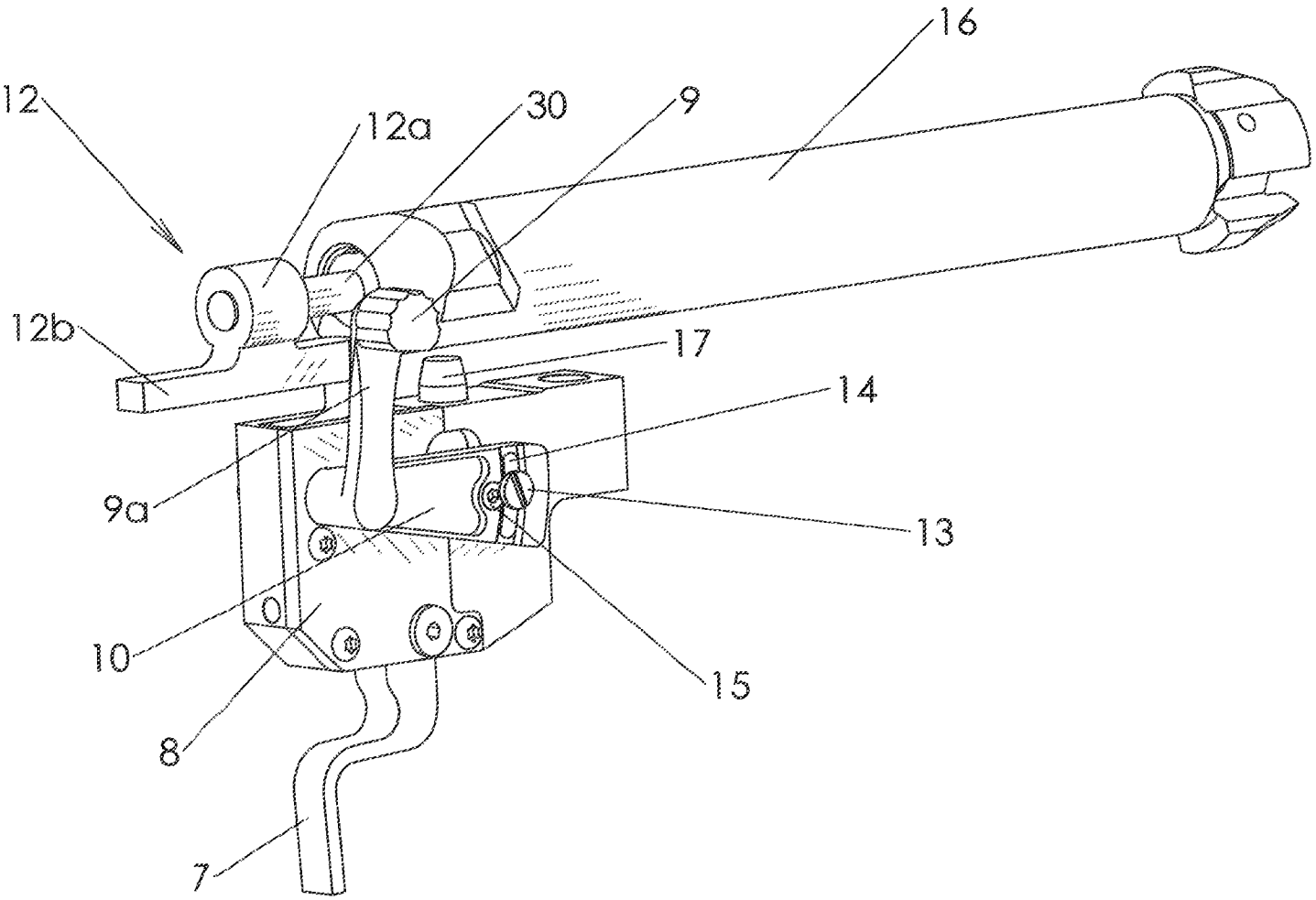
FIG. 12 is a perspective view of the present invention shown with the action housing and bolt shroud removed and the safety key in a second position.
Figure 13:
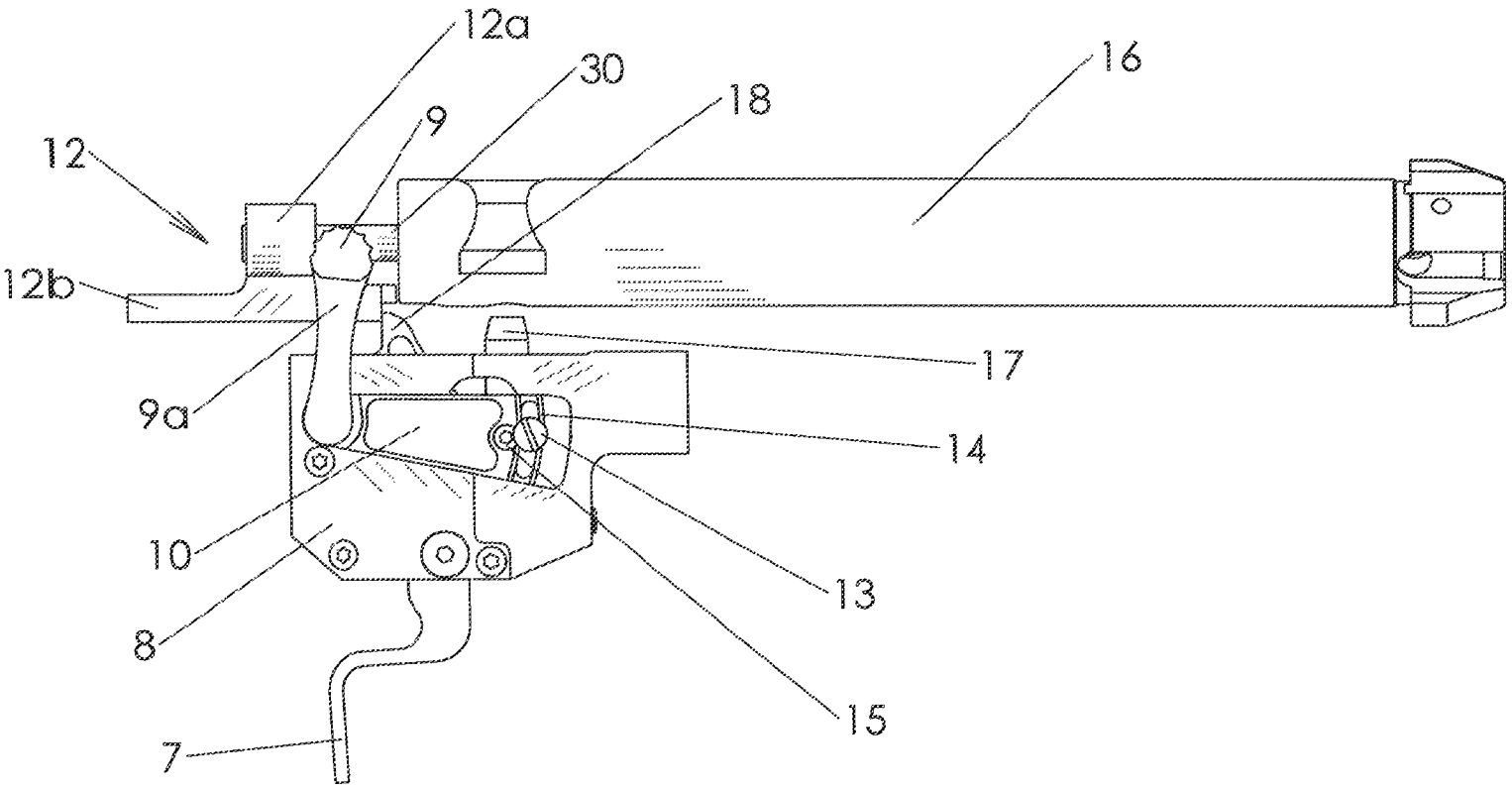
FIG. 13 is a side view of the present invention as shown in FIG. 12.

FIG. 12 is a first perspective view of the trigger mechanism of the present invention shown with the action housing and bolt shroud removed and the safety key in a second position. In this figure, the safety knob 9 has been pushed forward, thereby rotating the safety key 10 about pivot point "C" (see FIG. 11) and causing the shoulder screw 13 to move into a second or middle position within the slot 14 in the safety key. At the same time, the ball 19*a* moves into a different receptacle 23 on the other side of the safety key 10 (see FIG. 14). When this happens, the bolt lock 17 is moved downward so that it is no longer engaged with the bolt 16. In this second position, the bolt can be rotated and pulled backward, thereby allowing a bullet to be placed into (typically from a magazine) or removed from the chamber. The sear 18, however, is still engaged with the cocking piece 12 (see FIG. 13), thereby preventing the cocking piece 12 from moving forward and the firearm from being discharged. In other words, the trigger 7 is still in a locked position. In addition, the trigger 4 cannot be pulled because the rear end of the bolt lock 25 is abutting up against the front face of the sear engagement 22. In other words, in the second position, the sear engagement 22 is prevented from rocking forward by the bolt lock guide 25 (see also FIG. 15).

Figure 14:
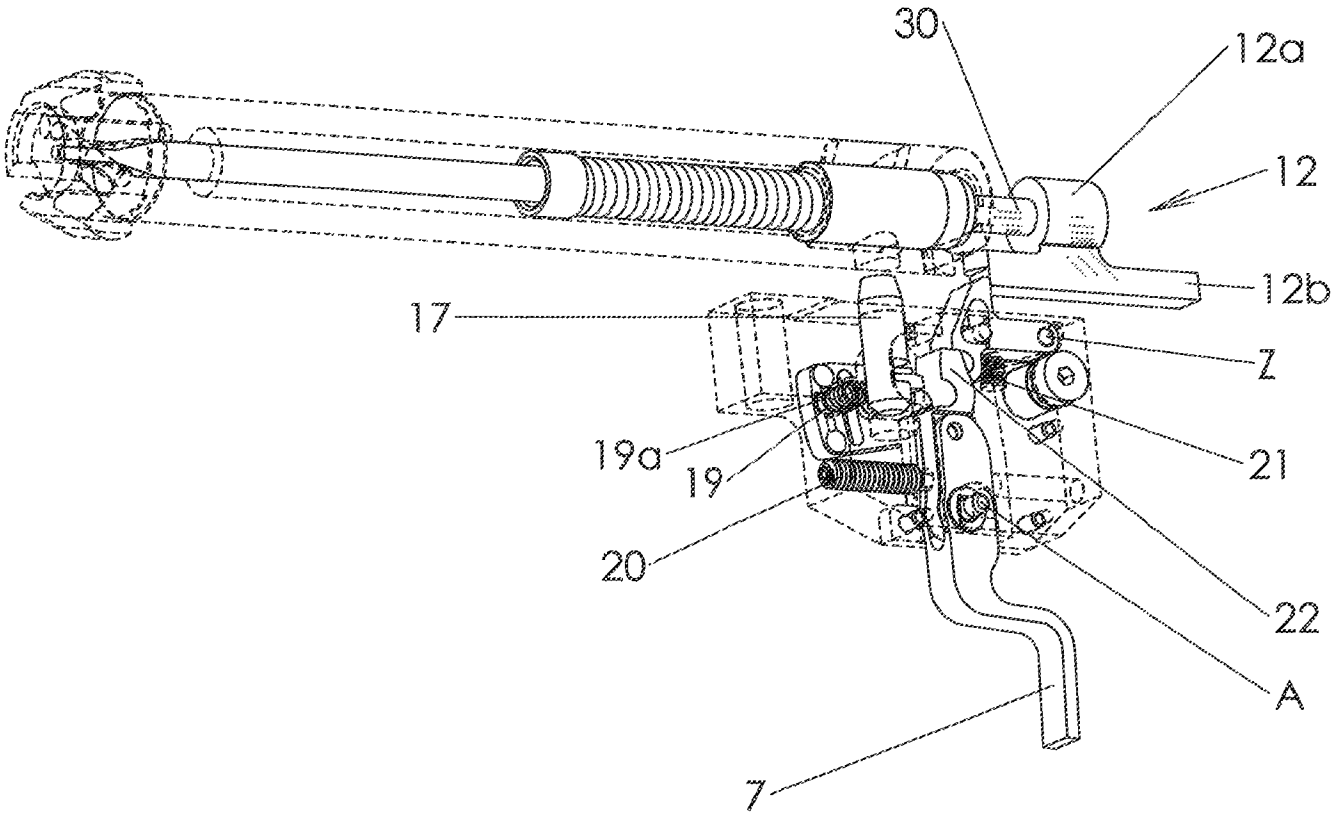
FIG. 14 is a perspective view of the present invention shown with the bolt and trigger housing in dotted lines for transparency and the safety key in a second position.

FIG. 14 is a perspective view of the present invention shown with the bolt and trigger housing in dotted lines for transparency and the safety key in a second position. As shown in this figure, when the safety key 10 is rotated forward, the ball 19*a* moves up into the middle receptacle 23, where the spring 19 keeps the ball in place until manual force is exerted on the safety key again. At the same time, the bolt lock guide 25 rotates with the safety key 10 and moves the bolt lock 17 downward into the position shown. In this position, the bolt lock 17 is no longer engaged with the bolt 16, which is now free to rotate with the bolt lever 5. Note that the trigger 7 has not been pulled.

Figure 15:
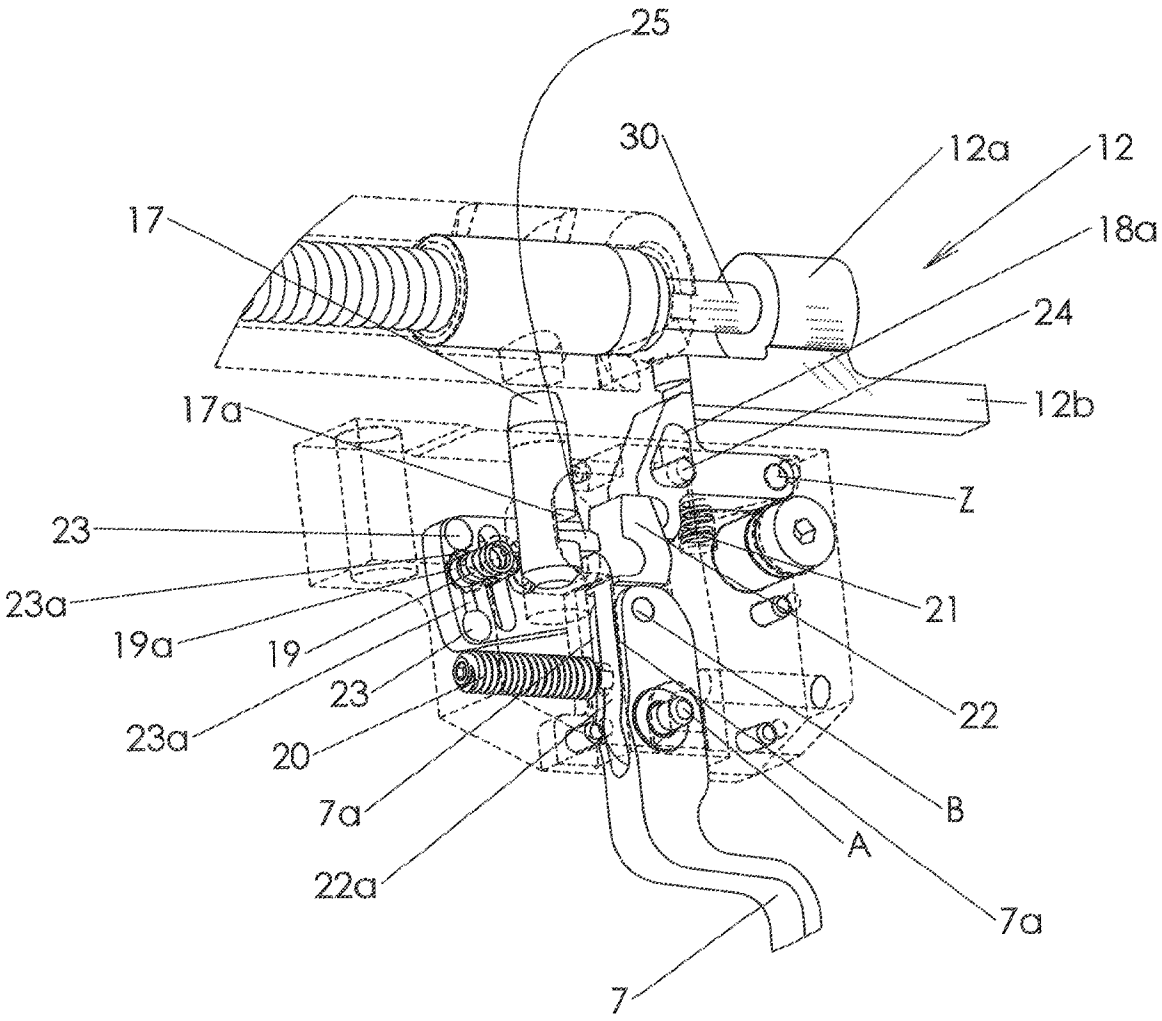
FIG. 15 is a detail view of the trigger mechanism shown in FIG. 14.

FIG. 15 is a detail view of the trigger mechanism shown in FIG. 14. In this figure, the trigger spring plunger 20 is maintaining the sear engagement 22 in an upright position. This second position-in which the bolt is unlocked but the trigger 7 is still in a safety position- and the manner in which this is accomplished is what renders the present invention unique as compared to all other inventions.

Figure 16:
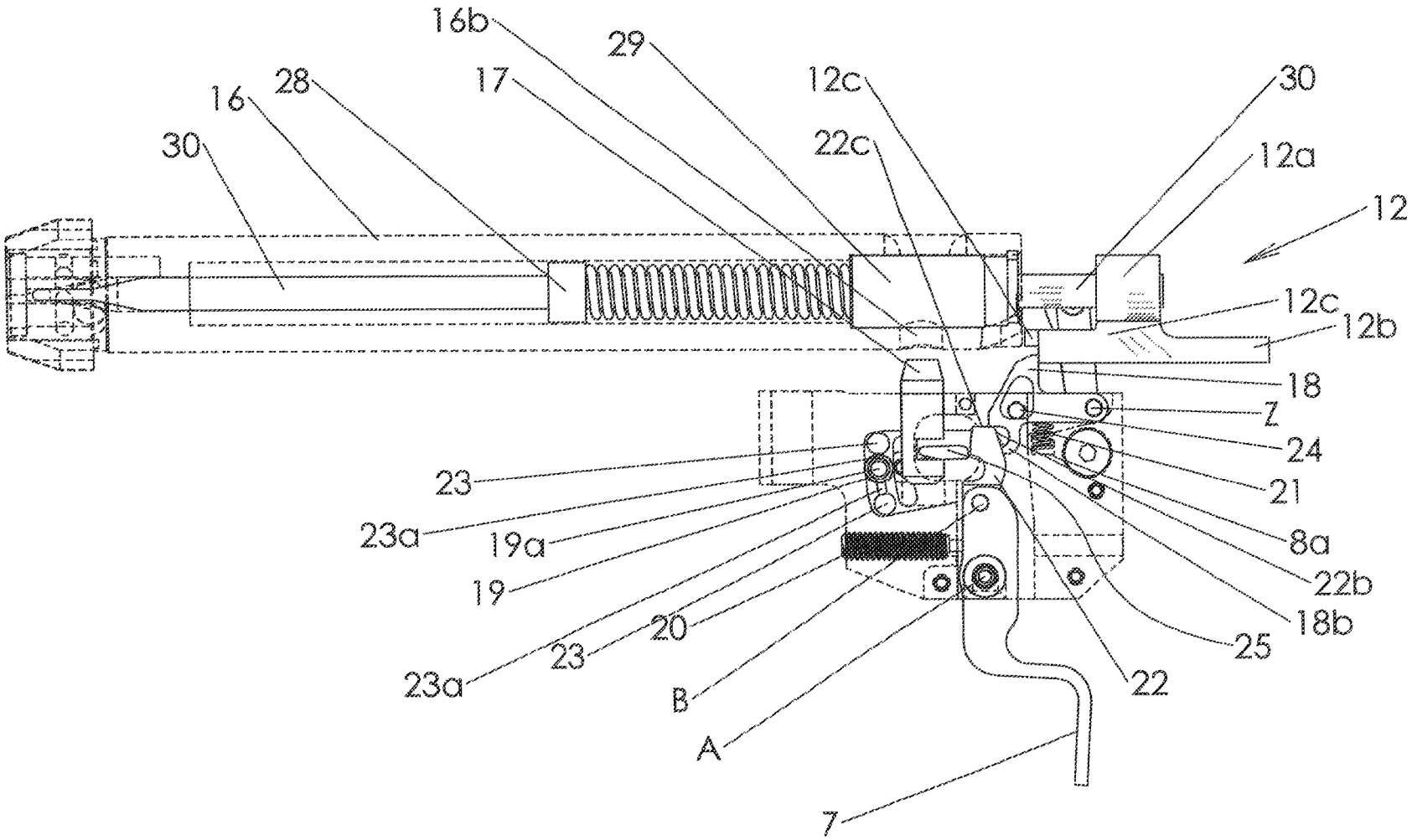
FIG. 16 is a side view of the present invention as shown in FIG. 14.

FIG. 16 is a side view of the present invention as shown in FIG. 14. As shown in this figure, in this position, the bolt lock guide 25 on the safety key 10 is in a horizontal position, pushing the bolt lock 17 down and out of the recess 16*b* in the bolt 16. Note that the trigger 7 has not been pulled and is in a fully upright (vertical) position. The sear engagement 22 and sear 18 are still engaged, as described above, and the sear 18 is still preventing the cocking piece 12 from moving forward. As shown in this figure, a compression spring 27 is situated inside of the bolt 16 and anchored on one end by a collar 28 and on the other end by the bolt seat 29. The firing pin 30 is secured on the proximal end by the cocking piece 12 and extends through the bolt seat 29, compression spring 27, and collar 28 and all the way to the distal end of the bolt 16, as shown.

Figure 17:
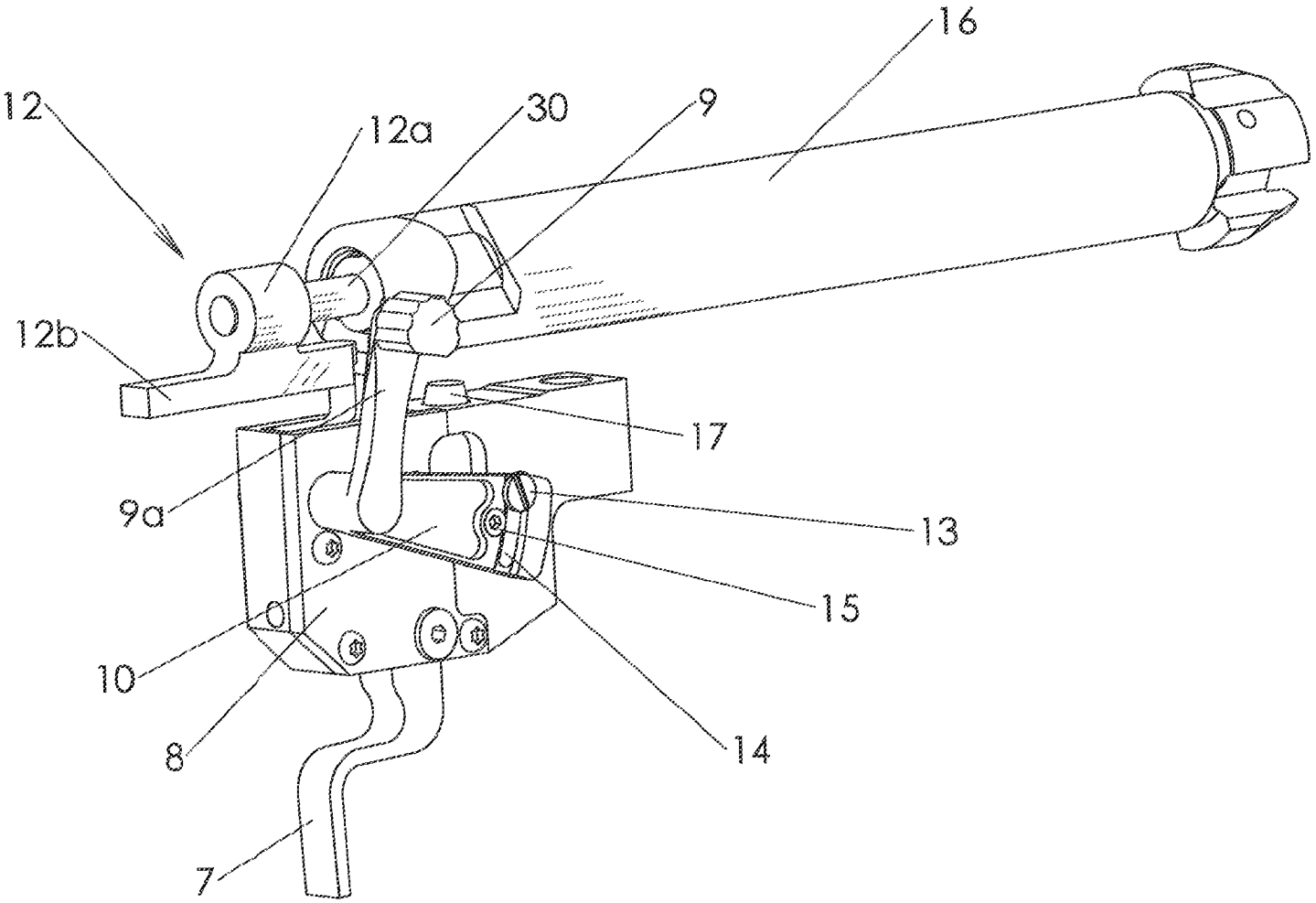
FIG. 17 is a perspective view of the present invention shown with the action housing and bolt shroud removed and the safety key in a third position prior to firing.
Figure 18:
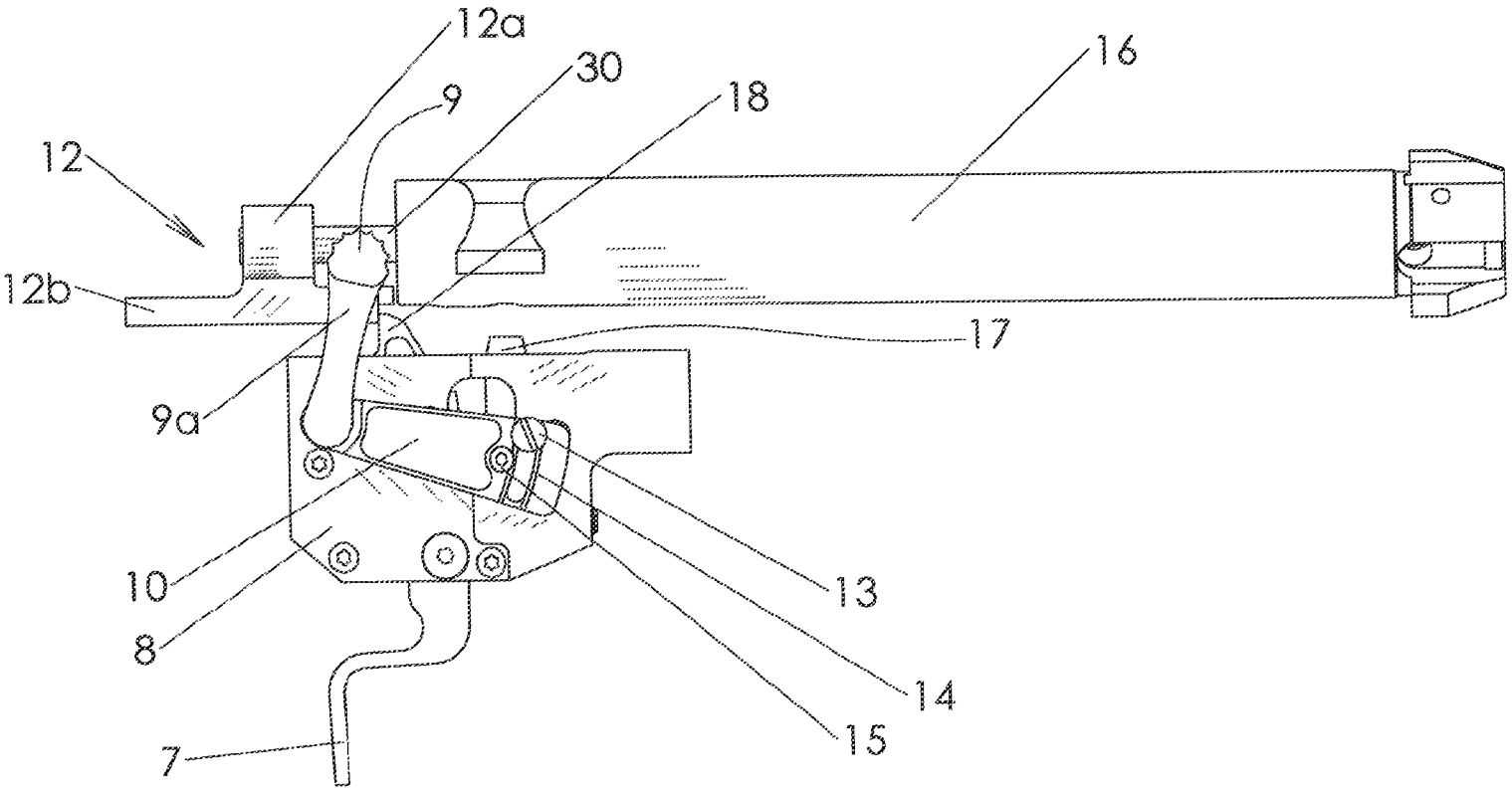
FIG. 18 is a side view of the present invention as shown in FIG. 17.

FIG. 17 is a perspective view of the present invention shown with the action housing and bolt shroud removed and the safety key in a third position prior to firing. In this figure, the safety knob 9 has been pushed forward again by the user, which rotates the safety key 10 downward and moves the shoulder screw 13 into the top of the slot 14 in the safety key 10. FIG. 18 is a side view of the present invention as shown in FIG. 17. Note also that when the safety key 10 is in the third position, the bolt lock guide 25 is no longer in contact with the front face of the sear engagement 22; instead, the rear end of the bolt lock guide 25 moves into a concave recess at the bottom of the front of the sear engagement 22, thereby freeing the sear engagement 22 and allowing it to rock forward (when the trigger is pulled). In both FIGS. 10 and 16, the rear end of the bolt lock guide 25 is abutting up against the front face of the sear engagement 22, which prevents it from rocking forward.

Figure 19:
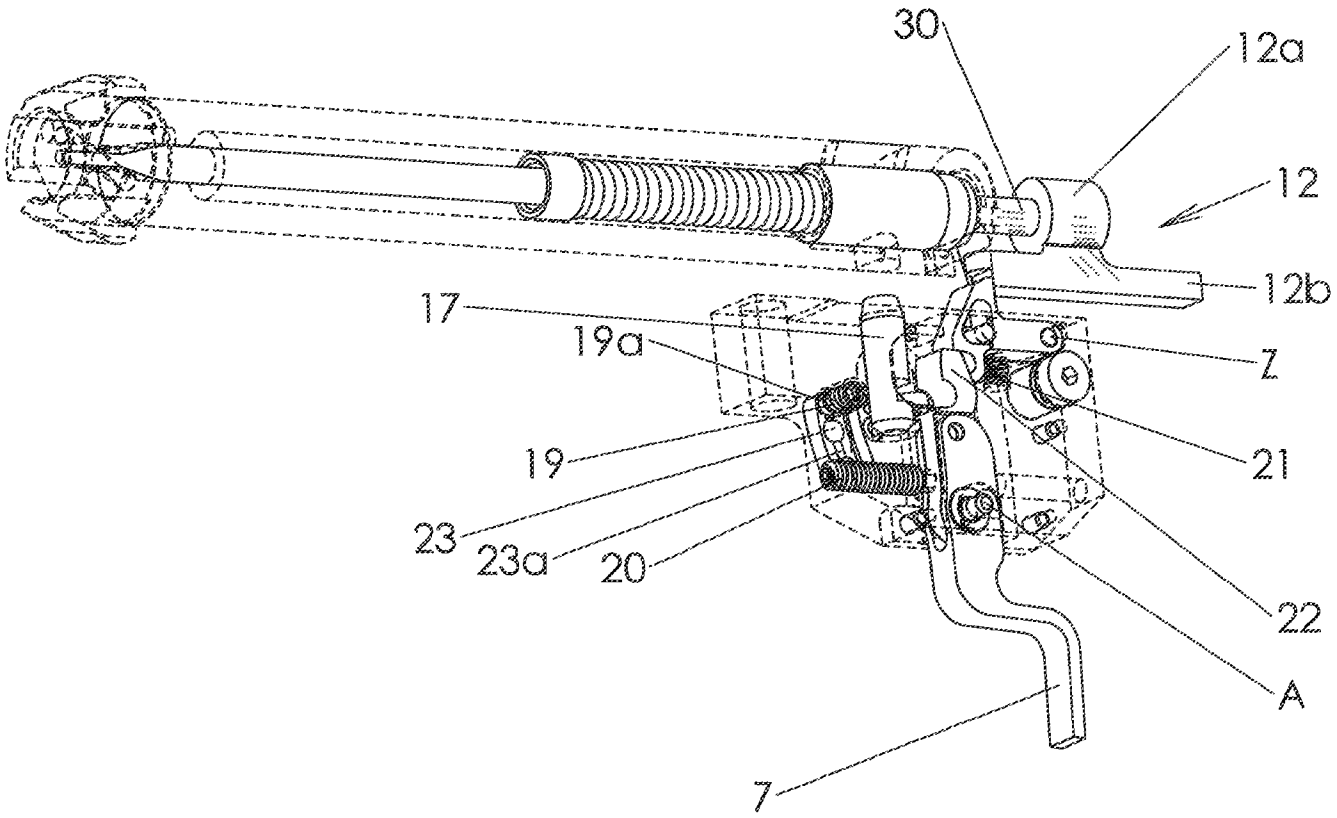
FIG. 19 is a perspective view of the present invention shown with the bolt and trigger housing in dotted lines for transparency and the safety key in a third position prior to firing.

FIG. 19 is a perspective view of the present invention shown with the bolt and trigger housing in dotted lines for transparency and the safety key in a third position prior to firing. As shown in this figure, the ball 19*a* is now situated in the upper-most receptacle 23 in the safety key 10. The trigger 7 has not yet been pulled and is in the same position as shown in the previous figures.

Figure 20:
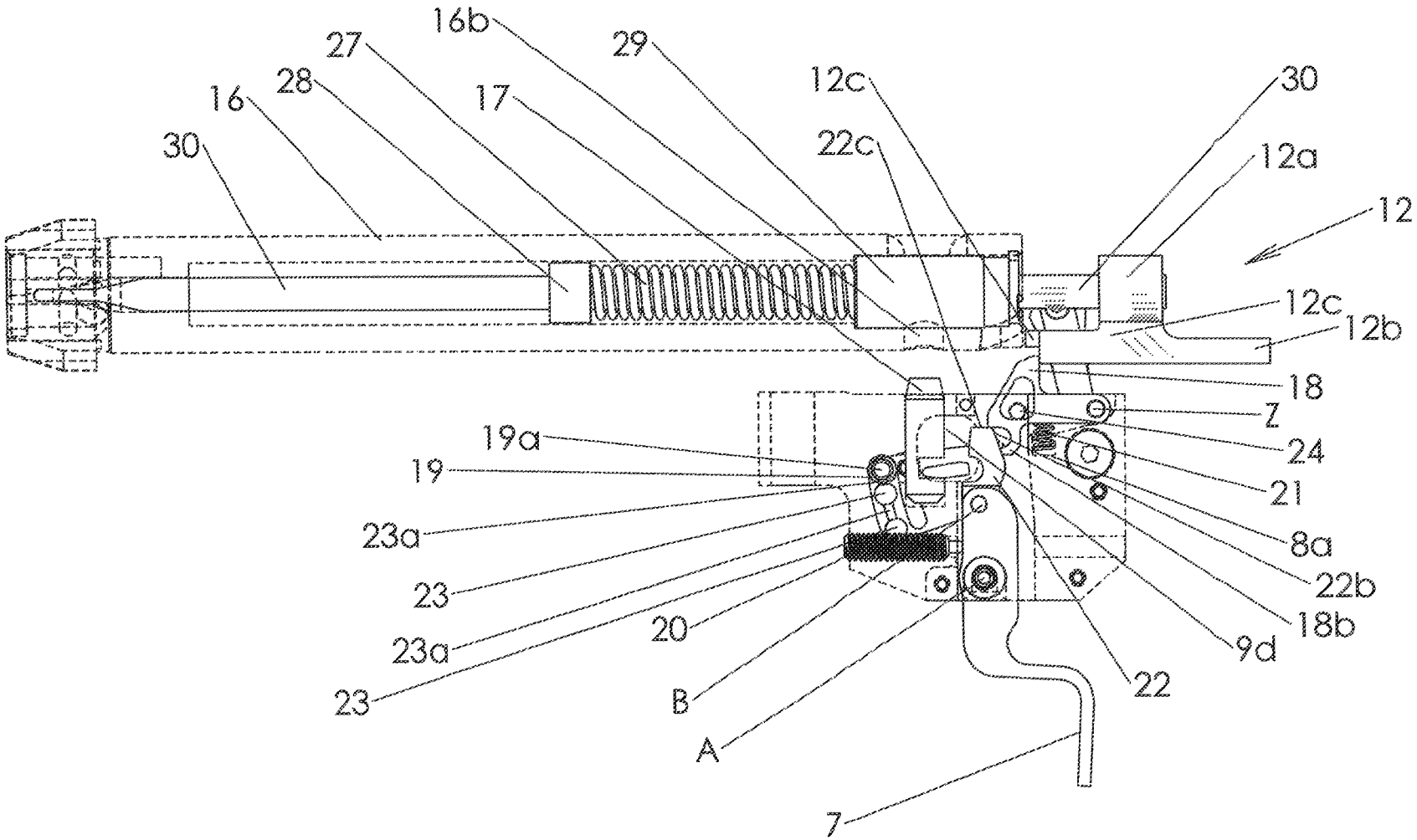
FIG. 20 is a side view of the present invention as shown in FIG. 19.

FIG. 20 is a side view of the present invention as shown in FIG. 19. As shown in this figure, the bolt lock guide 25 has pressed the bolt lock 17 further downward (as compared to FIG. 16). Because the trigger 7 has not yet been pulled, the sear engagement 22, sear 18, and cocking piece 12 are all in the same position as shown in the previous figures. The collar 28 is fixedly attached to the firing pin 30 so that these two parts move together. The bolt seat 29 is part of the bolt 16 and does not move relative to the bolt 16; the firing pin, however, slides inside of the bolt seat 29. The bolt seat 29 is also referred to as the "bolt handle guide" because it is the part of the bolt 16 to which the bolt lever 5 is attached (see FIG. 4).

Figure 21:
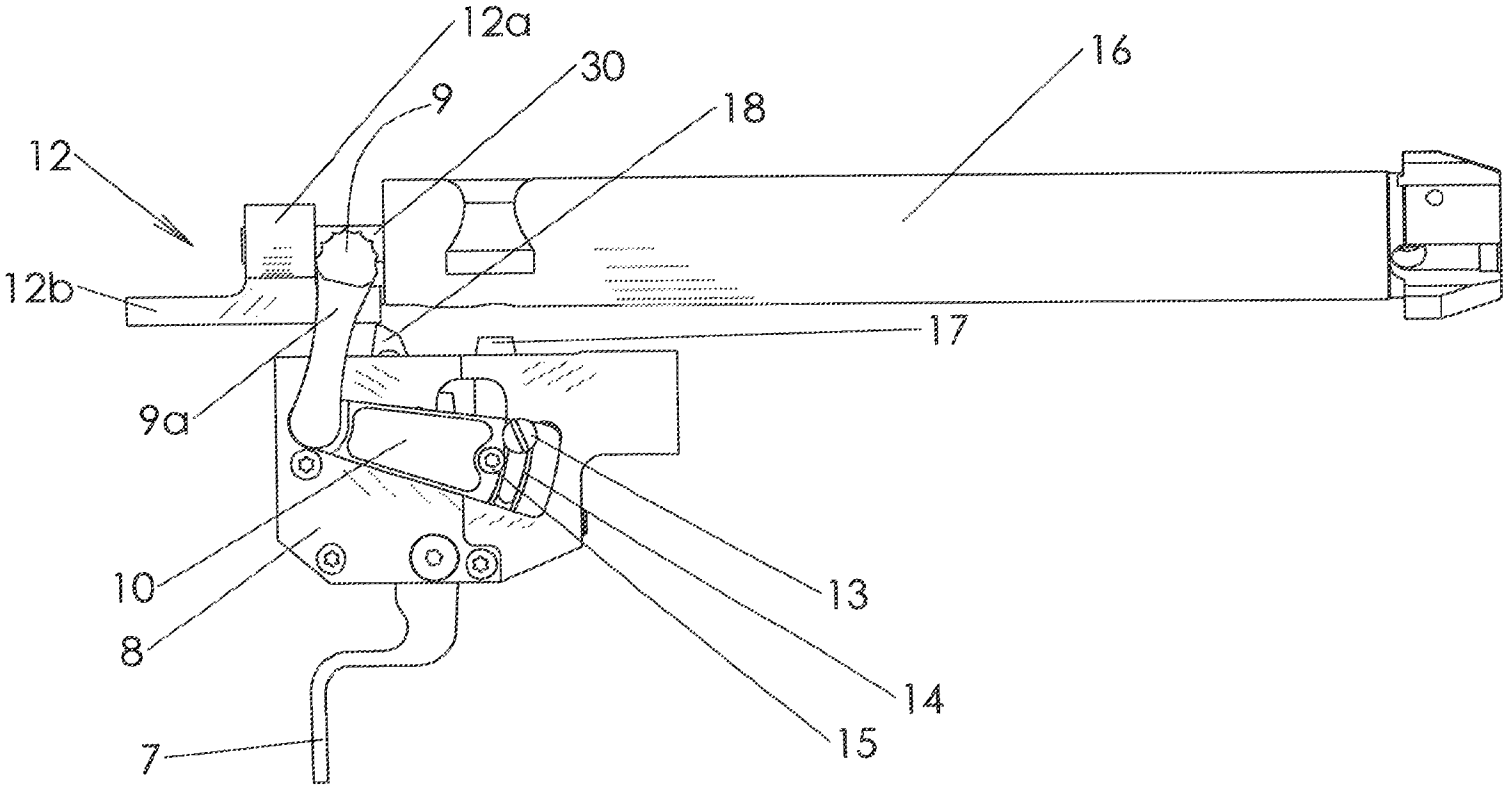
FIG. 21 is a first side view of the present invention shown with the trigger mechanism in the third position and the trigger pulled (post-firing).

FIG. 21 is a side view of the present invention shown with the trigger mechanism in the third position and the trigger pulled (post-firing). Although the movement of the trigger 7 is too slight to be noticeable in this figure, the user has pulled the trigger, resulting in disengagement of the sear 18 from the cocking piece 10, as is shown more clearly in FIG. 24.

Figure 22:
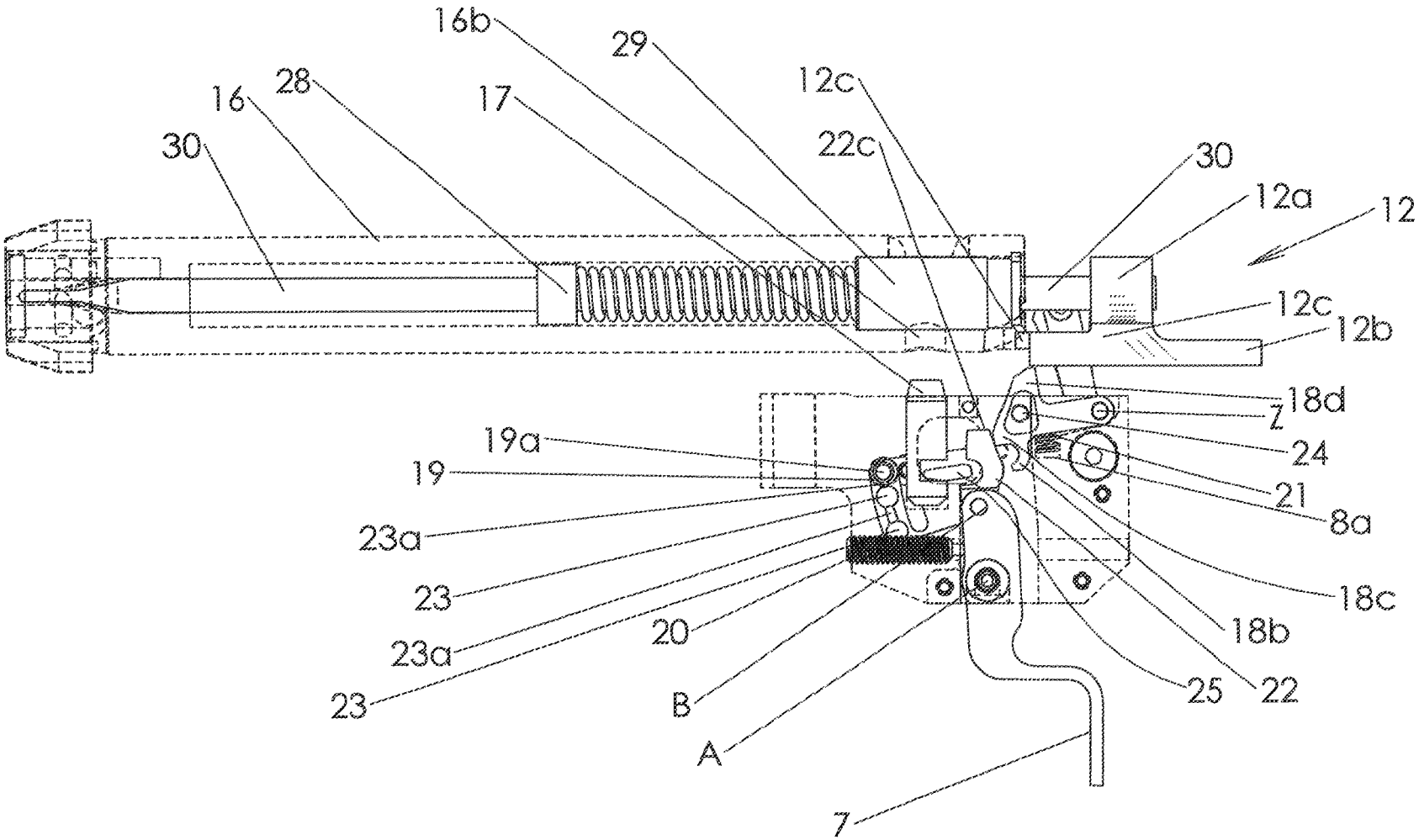
FIG. 22 is a second side view of the present invention as shown in FIG. 21 with the bolt and trigger housing dotted lines for transparency.

FIG. 22 is a second side view of the present invention as shown in FIG. 21 with the bolt and trigger housing dotted lines for transparency. As shown in this figure, when the trigger 7 is pulled, the sear engagement 22 rocks forward, thereby dislodging the lower claw 18*b* of the sear 18 and causing the nose 18*c* of the sear (which in previous positions was resting on the top surface 22*c* of the sear 18) to move downward along the curved rear face 22*b* of the sear engagement 22. At the same time, the top part 18*d* of the sear 18 (above the window 18*a*) rotates downward, thereby disengaging the sear 18 from the cocking piece 12. When this happens, the compression spring 27 is released (that is, it extends), thereby pushing the cocking piece 12, collar 28 and firing pin 30 forward. The firing pin 30 ignites the cartridge (not shown), but the spring 27 must be compressed again so that the cocking piece 12 can move backward and the sear 18 can re-engage with the cocking piece. The spring 27 is compressed again during cocking when the bolt 16 is pushed back into the action housing, thereby loading the cartridge into the chamber. When the user lets go of the trigger 7, the trigger spring plunger 20 forces the trigger back into an upright position, and the sear spring 21 forces the sear 18 back up into its initial position.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A trigger mechanism for a rifle comprising:
(a) a trigger housing;
(b) a trigger;
(c) a cocking piece;
(d) a bolt lock;
(e) a safety key that is configured to pivot relative to the trigger housing;
wherein the safety key comprises a bolt lock guide;
wherein the bolt lock guide is configured to fit within a recess in the bolt lock;
wherein the bolt lock guide is configured to move among a first position, a second position, and a third position as the safety key is rotated; and
wherein when the bolt lock guide is in the first position, the bolt is prevented from rotating, and when the bolt lock guide is in the second position or the third position, the bolt is free to rotate;
(f) a sear that is pivotally connected to the trigger housing at a sear pivot point;
wherein the sear is configured to pivot between a first position and a second position; and
wherein when the sear is in the first position, the sear is configured to prevent the cocking piece from moving forward, and when the sear is in the second position, the cocking piece is able to move forward;
(g) a sear engagement that is fixedly attached to an upper part of the trigger and configured to rock forward when a bottom part of the trigger is pulled by a user;
wherein when the bolt lock guide is in the first position or the second position, a rear end of the bolt lock guide abuts up against a front face of the sear engagement, thereby preventing the sear engagement from rocking forward; and
wherein when the bolt lock guide in the third position, the sear engagement is free to rock forward; and
(h) a ball detent spring;
wherein the ball detent spring is configured to move among a first position, a second position, and a third position on an inside surface of the safety key.

2. The trigger mechanism of claim 1, wherein the safety key is fixedly connected to a safety lever;
wherein the safety lever with a bottom end is fixedly connected to a safety knob; and
wherein the bottom end of the safety lever is connected to the safety key at a safety key pivot point.

3. The trigger mechanism of claim 1, further comprising a trigger spring plunger that is configured to maintain the trigger in an upright position when the trigger spring plunger is uncompressed.

4. The trigger mechanism of claim 1, further comprising a sear spring that is configured to maintain the sear in the first position when the sear spring is uncompressed.

5. The trigger mechanism of claim 1, further comprising a sear stop that is attached to the trigger housing and configured to prevent the sear from over-rotating.

6. The trigger mechanism of claim 1, wherein the cocking piece comprises an annular collar and a base;

wherein the cocking piece further comprises an arcuate extension that is configured to fit within a concave recess at a rear end of the bolt; and wherein the annular collar is configured to receive a proximal end of a firing pin.

7. The trigger mechanism of claim 1, wherein a sear spring is situated within a compartment inside of the trigger housing;

wherein a bottom end of the sear spring is in contact with a bottom of the compartment; and wherein a top end of the sear spring is in contact with a lower surface of the sear forward of the sear pivot point.

8. The trigger mechanism of claim 1, wherein the sear comprises a top part, a nose, and a lower claw; and wherein when the sear is in the first position, a bottom part of the lower claw is in contact with a curved rear face of the sear engagement, and a top edge of the lower claw is situated on top of a flat top surface of the sear engagement.

9. The trigger mechanism of claim 8, wherein when the sear is in the second position, the lower claw is disengaged from the sear, the nose moves downward along a curved rear face of the sear, and the top part of the sear rotates downward, thereby disengaging the sear from the cocking piece.

* * * * *